US007454022B2

(12) United States Patent
Neumann et al.

(10) Patent No.: US 7,454,022 B2
(45) Date of Patent: Nov. 18, 2008

(54) MULTI-MODE AMBIENT SOUNDSTAGE SYSTEM

(75) Inventors: Christopher Neumann, Granada Hills, CA (US); Brian D. Castro, Hermosa Beach, CA (US); Ara H. Gharapetian, Porter Ranch, CA (US); Eric Leicht, Thousand Oaks, CA (US); Timothy Prenta, Simi Valley, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 1177 days.

(21) Appl. No.: 10/234,975

(22) Filed: Sep. 4, 2002

(65) Prior Publication Data

US 2003/0118194 A1 Jun. 26, 2003

Related U.S. Application Data

(60) Provisional application No. 60/317,153, filed on Sep. 4, 2001.

(51) Int. Cl.
*H04R 29/00* (2006.01)
*H04R 5/02* (2006.01)

(52) U.S. Cl. ..... 381/59; 381/307

(58) Field of Classification Search ..... 381/59, 381/58, 307
See application file for complete search history.

(56) References Cited

U.S. PATENT DOCUMENTS

| | | | | |
|---|---|---|---|---|
| 5,043,970 | A | 8/1991 | Holman | 369/89 |
| 5,199,075 | A * | 3/1993 | Fosgate | 381/307 |
| 5,222,059 | A | 6/1993 | Holman | 369/89 |
| 5,526,456 | A | 6/1996 | Heinz | 381/156 |
| 5,850,457 | A * | 12/1998 | Gefvert | 381/300 |
| 6,118,883 | A | 9/2000 | Rocha | 381/387 |
| 7,088,827 | B1 * | 8/2006 | Vishwamitra | 381/123 |
| 2002/0131611 | A1 * | 9/2002 | Hoover et al. | 381/123 |
| 2002/0146139 | A1 * | 10/2002 | Oplinger | 381/300 |

* cited by examiner

*Primary Examiner*—Stella L Woo
(74) *Attorney, Agent, or Firm*—The Eclipse Group LLP

(57) ABSTRACT

A multi-mode sound reproduction device is disclosed including a direct radiation sound device, a diffuse radiation sound device and a selection device in signal communication with both the direct radiation sound device and diffuse radiation sound device, the selection device capable of selecting between the direct radiation sound device for one mode of operation and the diffusion radiation sound device for another mode of operation in response to a received control signal.

30 Claims, 34 Drawing Sheets

MULTI-MODE AMBIENT SOUNDSTAGE SYSTEM

CROSS-REFERENCE TO RELATED APPLICATIONS

This application claims the benefit of Provisional Patent Application Ser. No. 60/317,153, filed on Sep. 4, 2001, and entitled "System and Method For Producing a Multi-mode Ambient Soundstage."

BACKGROUND OF THE INVENTION

1. Field of the Invention

This invention relates to sound reproduction devices, and in particular to a system for producing a multi-mode ambient soundstage in a home theater environment.

2. Related Art

Sound reproduction devices such as loudspeakers are utilized in a broad range of applications in many distinct fields of technology including the consumer and industrial fields. Sound reproduction devices utilize a combination of mechanical and electrical components to convert received electrical signals, representative of the sound, into mechanical energy that produces sound pressure waves in an ambient sound field corresponding to the received electrical signals.

In today's society, the utilization of home theater systems is increasing as consumers attempt to reproduce the cinema and concert theater experiences within their homes. As a result, manufactures have produced numerous types of audio and video systems capable of reproducing different types of theater environments within the home of a consumer. These theater environments include analog and digital surround sound, Dolby® digital sound, digital theater System ("DTS"), extended DTS ("DTS-ES"), THX® and other digital signal processing ("DSP") modes.

The audio and video systems capable of producing these theater environments include numerous electronic components and loudspeakers. Typically the systems include from six to eight loudspeakers to produce various ambient sound fields. As an example of a cinema theater environment, a 5.1 type cinema theater system includes a pair of left and right front loudspeakers, a center channel loudspeaker, a pair of left surround loudspeakers and a subwoofer loudspeaker. A 6.1 type cinema theater system includes a pair of left and right front loudspeakers, a center channel loudspeaker, a pair of left surround loudspeakers, a back surround sound loudspeaker and a subwoofer loudspeaker. And a 7.1 type cinema theater system includes a pair of left and right front loudspeakers, a center channel loudspeaker, a pair of left surround loudspeakers, a pair of right and left back surround sound loudspeakers and a subwoofer loudspeaker.

A problem with these audio and video systems is that the surround sound loudspeakers in these systems are either dipolar or bipolar and are placed external to the wall surfaces of a room containing the system. As a result, mass consumer acceptance of some of these types of systems is relatively low because the surround loudspeaker are bulky, visually unappealing and tend to force a consumer to utilize the room exclusively for a cinema home theater system. Attempts have been made at utilizing in-wall and in-ceiling loudspeakers. However, it is difficult to produce an ambient sound field equivalent to the external surround sound loudspeakers with a sound reproduction system that is imbedded and flush within the wall and ceiling surfaces because the dispersion from its locations within walls are obscured by the wall and ceiling surfaces. Typically, unless the loudspeaker is capable of producing an angled pattern for the sound, the loudspeaker will be obstructed and will not be able to create the type of sound stage that is desirable for accurate sound reproduction within the home theater system. Therefore, there is a need for a sound reproduction system that is capable of producing an ambient sound field equivalent to external surround sound loudspeakers while being imbedded in the wall and/or ceiling and being flush with the wall and ceiling surfaces of a room.

An additional problem with these audio and video systems is that typically rooms are arranged differently from home-to-home. Some rooms are small and have four walls while others may be large and only have three, or two, main walls that are compatible for placing loudspeakers. Thus, there is also a need for a sound reproduction system that is capable of producing an ambient sound field equivalent to external surround sound loudspeakers while being imbedded in various locations on the walls and ceilings of a room, while at the same time being flush with the wall and ceiling surfaces of the room.

Still another problem is that generally audio and video systems that are optimized for a cinema environment are different than audio systems that are optimized for a music listening environment. Typically, cinema environments require dipolar or bipolar surround sound loudspeaker configurations to produce diffuse ambient sound fields, while music listening environments require direct radiating type loudspeakers to accurately reproduce the music. Thus there is also a need for a sound reproduction system that is capable of producing an ambient sound field for both cinema and music environments equivalent to external surround sound loudspeakers while being imbedded in the wall and/or ceiling and being flush with the wall and ceiling surfaces of a room.

SUMMARY

A multi-mode sound reproduction system is described for producing a multi-mode ambient soundstage. The multi-mode sound reproduction system may be broadly conceptualized as a system that allows for multiple modes of operation of home theater system for both a cinema and music listening environment. The system may receive a control signal and determine the mode of operation of the system corresponding to the control signal.

An example implementation of the multi-mode sound reproduction device may include a direct radiation device, a sound array and a selection device in signal communication with both the direct radiation device and sound array, the selection device capable of selecting between the direct radiation device for one mode of operation and the combination of the direct radiation device and sound array for another mode of operation in response to a received control signal.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following Figures. The components in the Figures are not necessarily to scale, emphasis instead being placed upon illustrating the principles of the invention. Moreover, in the Figures, like reference numerals designate corresponding parts throughout the different views.

DETAILED DESCRIPTION

Figure 1:
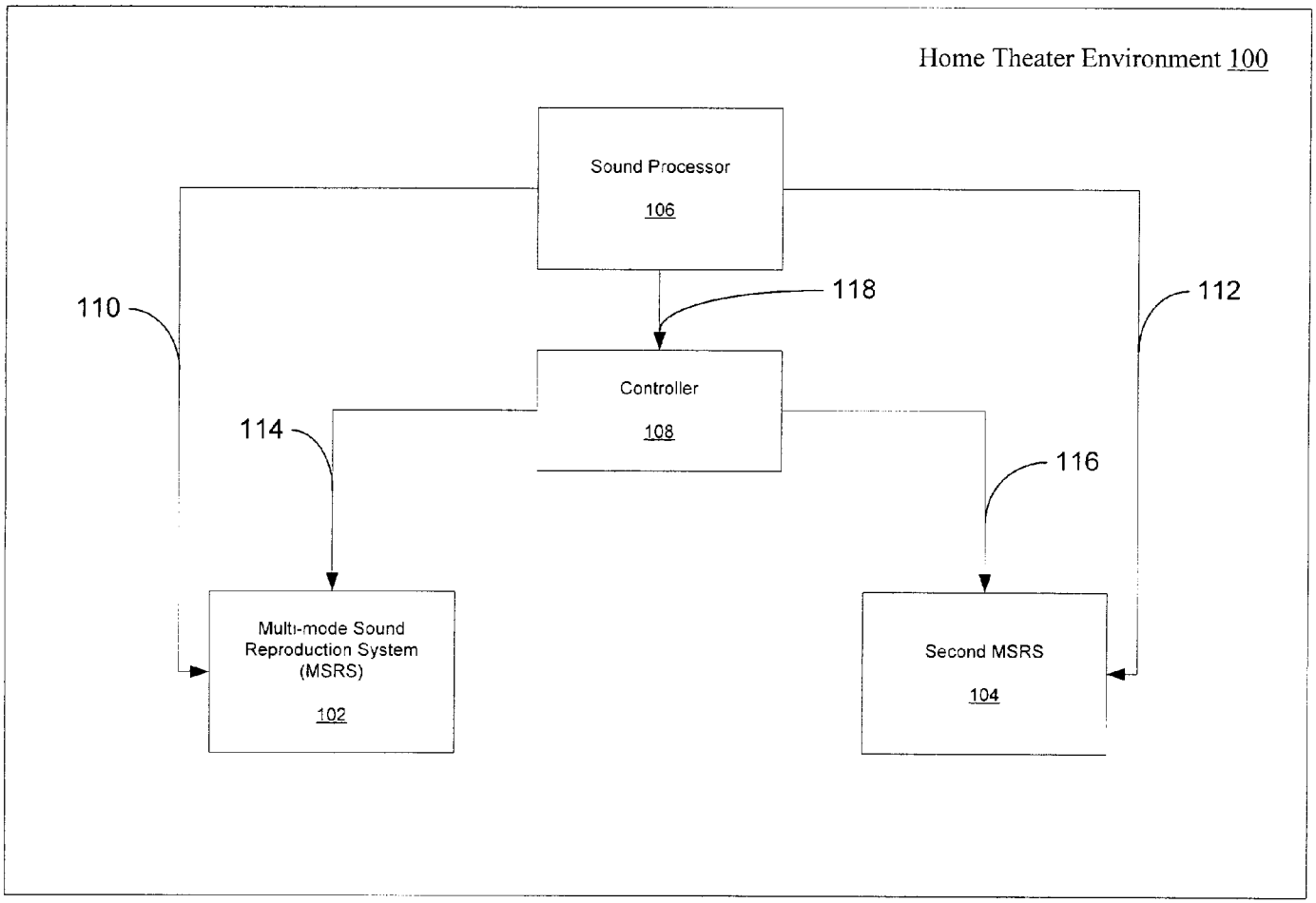
FIG. 1 is a block diagram illustrating a simplified home theater environment having multi-mode sound reproduction system ("MSRS").

In FIG. 1, a block diagram illustrating a simplified home theater environment 100 is shown having a multi-mode sound reproduction system ("MSRS") 102. The home theater environment also may include a second MSRS 104, a sound processor 106 (such as a surround sound processor), and a controller 108. The MSRS 102 and second MSRS 104 are in signal communication with both the sound processor 106 and controller 108 via signal paths 110, 112, 114 and 116, respectively. The controller 108 is in signal communication with the sound processor 106 via signal path 118.

The MSRS 102 may be a loudspeaker system capable of producing sound within the home theater environment 100 responsive to electrical signals received from the sound processor 106 via signal path 110. The MSRS 102 is also capable of operating in different modes of operation responsive to the controller 108. The MSRS 102 may include more than one loudspeaker driver such as a woofer driver, midrange driver and tweeter driver. The different modes of operation may include a direct mode of operation ("DIRECT") and a diffuse mode of operation ("DIFFUSE").

The sound processor 106 may be a surround sound processor (either as a stand alone device or as part of audio/video receiver) or other equivalent type of digital signal processor capable of producing electrical signals corresponding to the surround sound channels required to produce a surround sound environment in the home theater environment 100. Examples of sound processor 106 may include processors produced from Harman International Industries, Inc. of Northridge, Calif., such as the Lexicon MC-12 or other processors produced Sony Corp., of Japan, Mitsubishi Corp., of Japan, JVC of Japan, Panasonic of Japan, Pioneer of Japan, Denon of Japan, Yamaha of Japan, Samsung of Korea, Philips of the Netherlands or other equivalent products.

The controller 108 may be a separate device that sends trigger signals, via signal paths 114 and 116, to the MSRS 102 and second MSRS 104 to change mode of operation response to a command from the sound processor 106 via signal path 118. The controller 108 may also be a component located within the sound processor 106.

Figure 2:
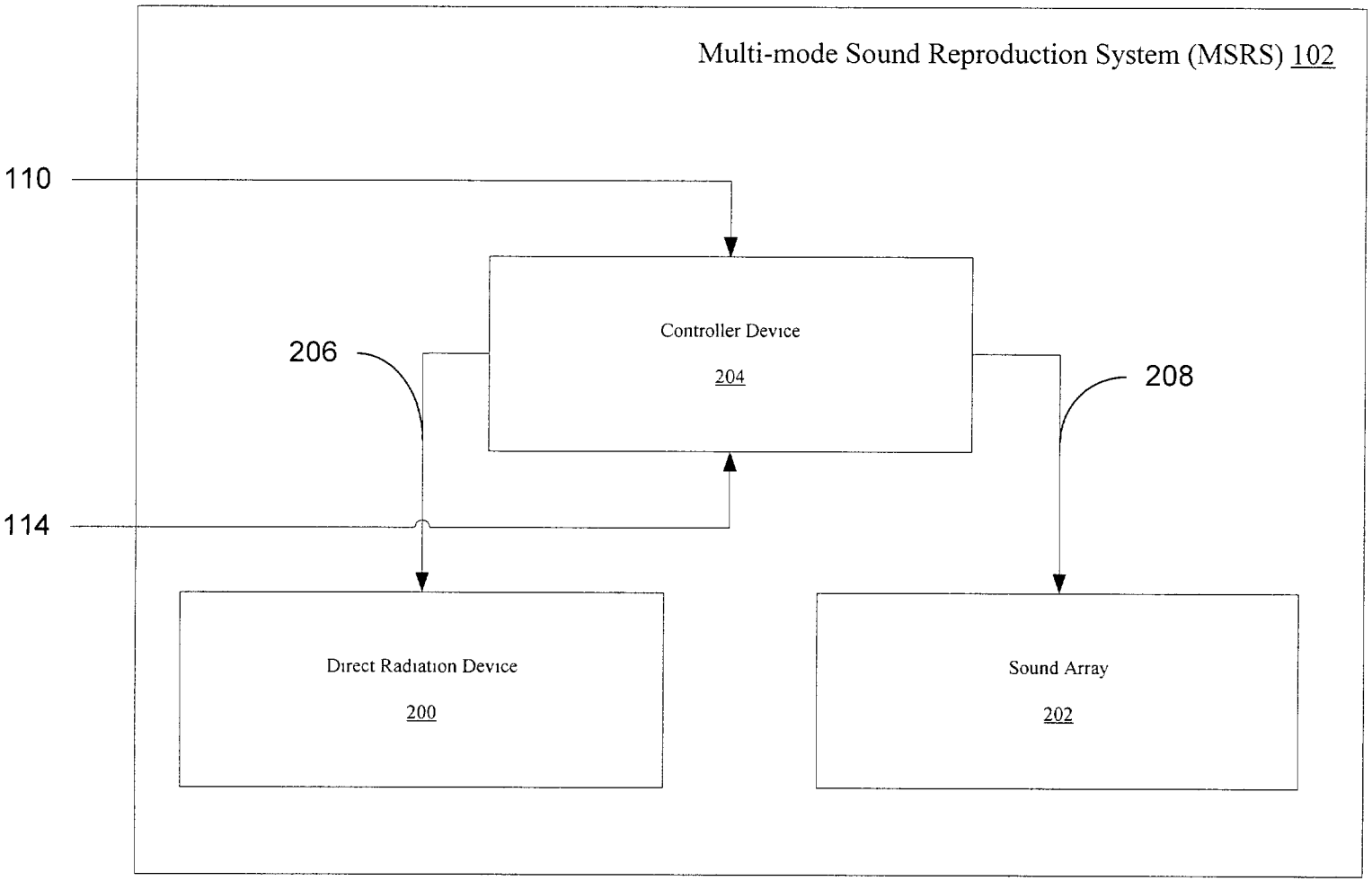
FIG. 2 is a block diagram illustrating the MSRS element of FIG. 1.

In FIG. 2, a block diagram illustrating the MSRS 102 of FIG. 1 is shown. The MSRS 102 may include a direct radiation device 200, a sound array 202 and a controller device 204. The direct radiation device 200 and sound array 202 are in signal communication with the controller device 204 via signal paths 206 and 208, respectively. The controller device 204 is in signal communication with the sound processor 106 and controller 108 via signal paths 110 and 114, respectively.

The MSRS 102 may be a multi-mode loudspeaker. The direct radiation device 200 may include a direct radiation driver loudspeaker (not shown) and the sound array 202 may include an array of driver loudspeakers (not shown). The controller device 204 selects between the direct radiation device 200 and the sound array 202, responsive to a signal received, via the signal path 114, from the controller 106.

Figure 3:
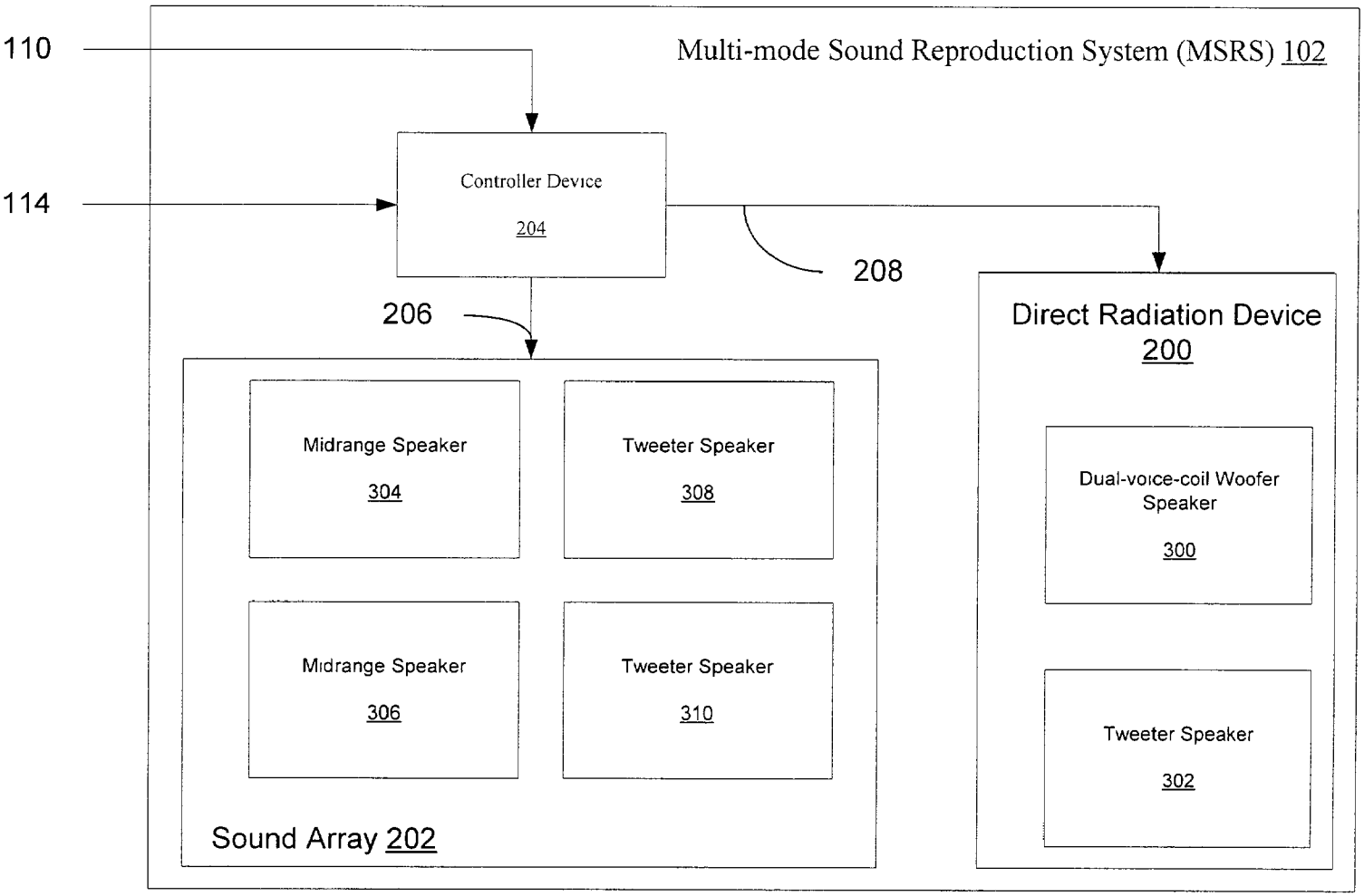
FIG. 3 is a block diagram illustrating an example implementation of the MSRS element of FIG. 1.
Figure 4:
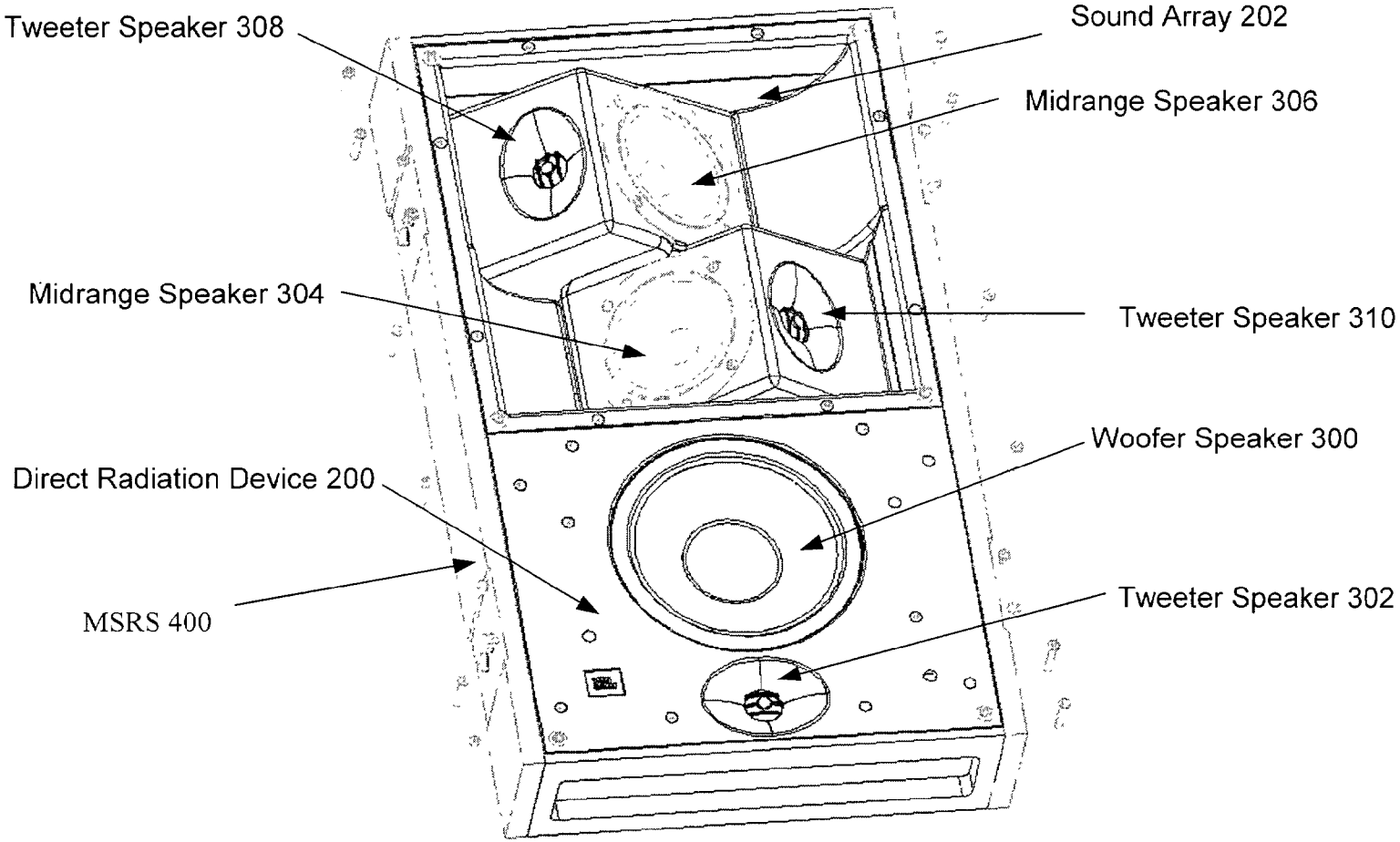
FIG. 4 is a front perspective view of an example implementation of the MSRS of FIG. 3.
Figure 5:
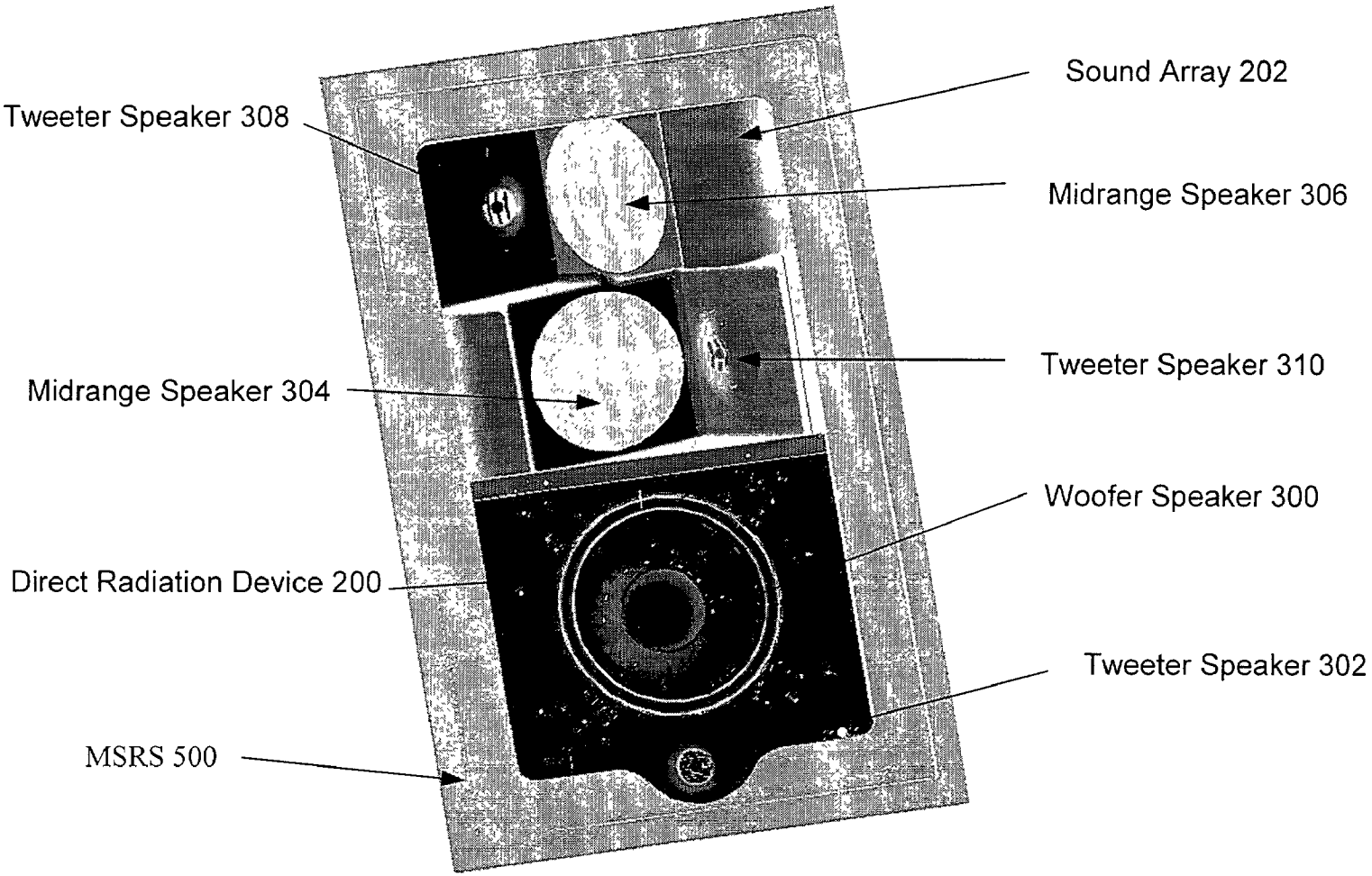
FIG. 5 is another front perspective view of the example implementation of the MSRS of FIG. 3.

An example implementation of the MSRS 102 is shown in FIG. 3. The direct radiation device 200 may include a woofer loudspeaker 300 as a low frequency loudspeaker driver and a tweeter speaker 302 as a high frequency driver. An example of the woofer loudspeaker 300 may be an eight-inch dual-voice-coil woofer while an example of the tweeter loudspeaker 302 may be an aquaplas-coated titanium dome tweeter, waveguide tweeter produced by JBL, Inc., a subsidiary of Harman International Industries, Inc., of Northridge, Calif., or other similar high frequency driver. The sound array 202 may include a set of midrange loudspeakers and tweeter loudspeakers. For illustrative purposes, an example implementation of the sound array 202 may include midrange speakers 304 and 306 and tweeter speakers 308 and 310. Examples of the midrange speakers 304 and 306 may include a three-inch or four-inch midrange speaker as a mid-frequency driver. Additionally, examples of the tweeter speakers 308 and 310 may include a one-inch aquaplas-coated titanium dome tweeter, waveguide tweeter produced by JBL or other similar high frequency driver. A front perspective view of the example implementation of the MSRS (400 and 500) is shown in FIG. 4 and FIG. 5. In this example the MSRS 400 may be implemented utilizing the Synthesis S4A from JBL, Inc., a subsidiary of Harman International Industries, Inc., of Northridge, Calif.

Figure 6:
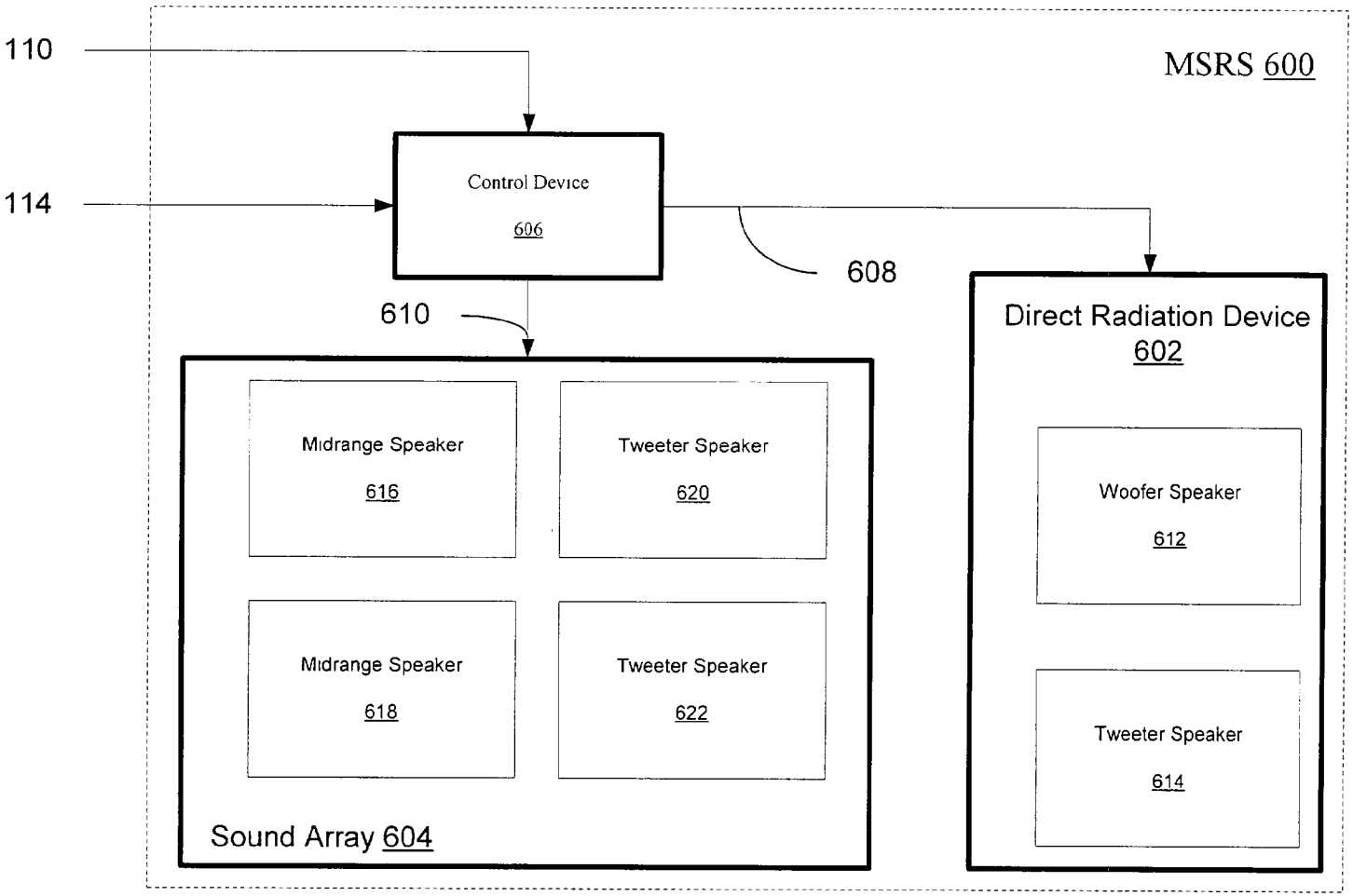
FIG. 6 is a block diagram illustrating another example implementation of the MSRS element of FIG. 1 utilizing discrete elements.

In FIG. 6, a block diagram illustrating another example implementation of the MSRS 600 utilizing discrete elements is shown. In this example implementation the MSRS 600 is not a signal component but instead a combination of components that include a direct radiation device 602, a sound array 604, and a control device 606. The direct radiation device 602 and sound array 604 are electrically connected to the control device 606 via signal paths 608 and 610, respectively.

The direct radiation device 602 may be any direct firing type loudspeaker. The sound array 604 may be any diffuse firing loudspeaker such as a dipole or bipolar surround sound type loudspeaker. The control device 606 may be any switch capable of switching the between utilizing the direct radiation device 602 and the sound array 604 in response to receiving a trigger signal from the controller 108, FIG. 1.

The direct radiation device 602 may include a woofer speaker 612 as a low frequency loudspeaker driver and a tweeter loudspeaker 614 as a high frequency driver. An example of the woofer loudspeaker 612 may be an eight-inch dual-voice-coil woofer while an example of the tweeter speaker 614 may be an aquaplas-coated titanium dome tweeter, waveguide tweeter produced by JBL or other similar high frequency driver. The sound array 604 may include a set of midrange speakers and tweeters. For illustrative purposes, an example implementation of the sound array 604 may include midrange speakers 616 and 618 and tweeter speakers 620 and 622. Examples of the midrange speakers 616 and 618 may include a three-inch or four-inch midrange speaker as a mid-frequency driver. Additionally, examples of the tweeter speakers 620 and 622 may include a one-inch aquaplas-coated titanium dome tweeter, waveguide tweeter produced by JBL or other similar high frequency driver.

Additionally, the direct radiation device 602 may be a typical loudspeaker device such as the BOSE 141®, 161™, 201®, 301®, 601™, 701®,and 901® produced by Bose Corporation of Framingham, Mass. or similar loudspeakers produced by Polk Audio of Baltimore, Md., B&W of the UK, Thiel Audio of Lexington, Ky., DCM Loudspeakers of Winslow, Ill., Klipsch of Indianapolis, Ind., Cerwin-Vega of Simi Valley, Calif., Vandersteen Audio of Hanford, Calif., Acoustic Research of Florida and others. The sound array 604 may include any midrange and tweeter type combination loudspeakers such the BOSE Acoustimass® 3, 5, 6, 8, 10, 15, 12, 25, 28, 30, 35 and 50 produced by Bose Corporation of Framingham, Mass. or similar loudspeakers produced by Polk Audio of Baltimore, Md., B&W of the UK, Thiel Audio of Lexington, Ky., DCM Loudspeakers of Winslow, Ill., Klipsch of Indianapolis, Ind., Cerwin-Vega of Simi Valley, Calif., Vandersteen Audio of Hanford, Calif., Acoustic Research of Florida and others.

Figure 7:
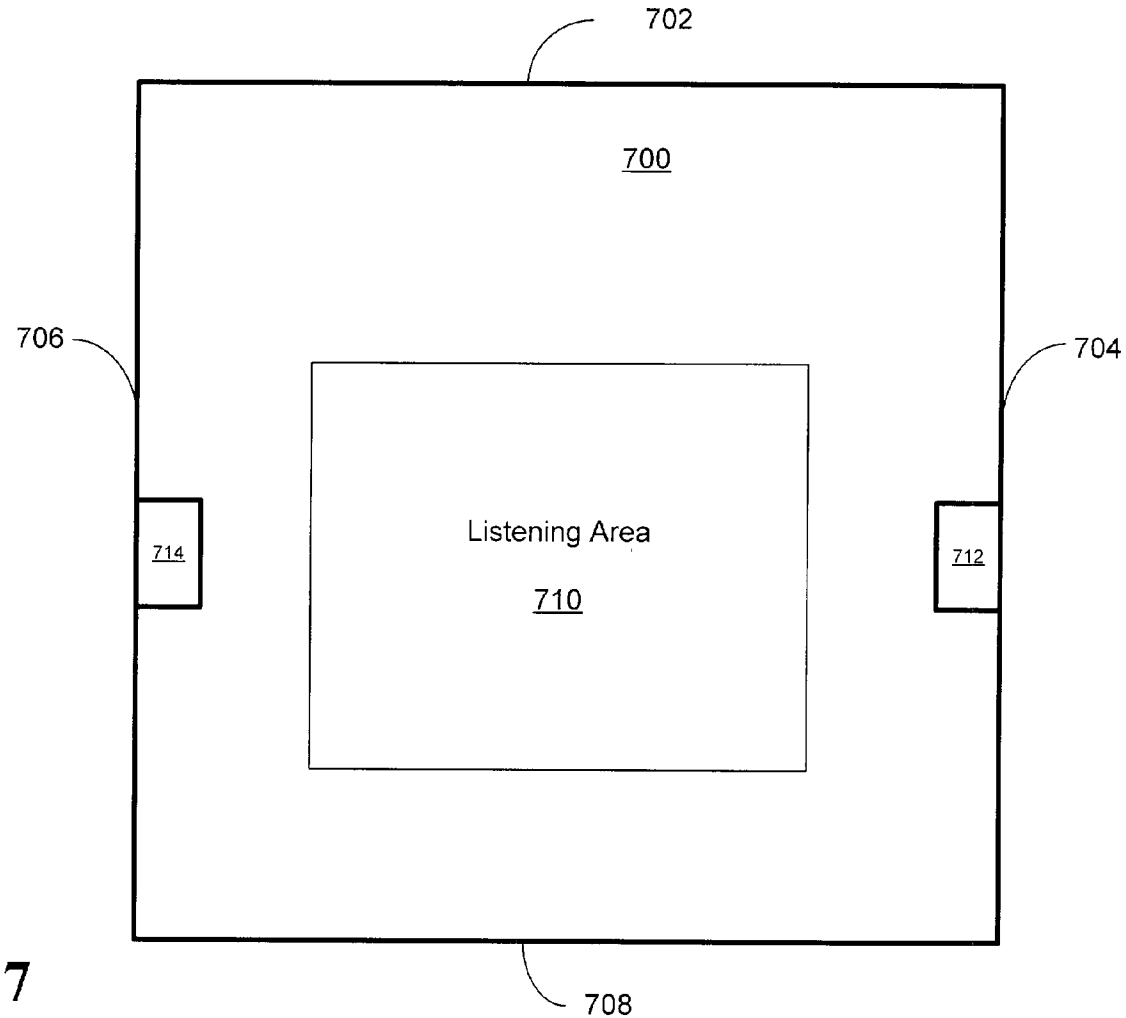
FIG. 7 is a top view of a loudspeaker layout in a typical home theater environment.

In FIG. 7, a top view of a loudspeaker layout in a typical home theater environment room 700 is shown. As an example, the room 704 is shown having four wall surfaces including front wall surface 702, right wall surface 704, left wall surface 706 and rear wall surface 708. The room 700 includes a listening area 710, a right MSRS 712 and a left MSRS 714. The right MSRS 712 and left MSRS 714 radiate sound waves into the room 700 responsive to information signals received from the driving electronics (not shown) such as the sound processor 106, FIG. 1. As a result, an ambient sound field (also known as a sound stage) will be created in the room 700 that is optimized at the listening area 710. This type of configuration is typically utilized in analog surround sound and DTS (such as 5.1 Dolby® stereo) sound environments.

Depending on the desired type of sound stage and/or decoding coming (originating) from a surround sound processor 106, the right MSRS 712 and left MSRS 714 will operate in one of three modes. The first mode of operation is generally known as DIRECT mode and is preferably utilized to create a music listening sound stage within the listening area 710.

Figure 8:
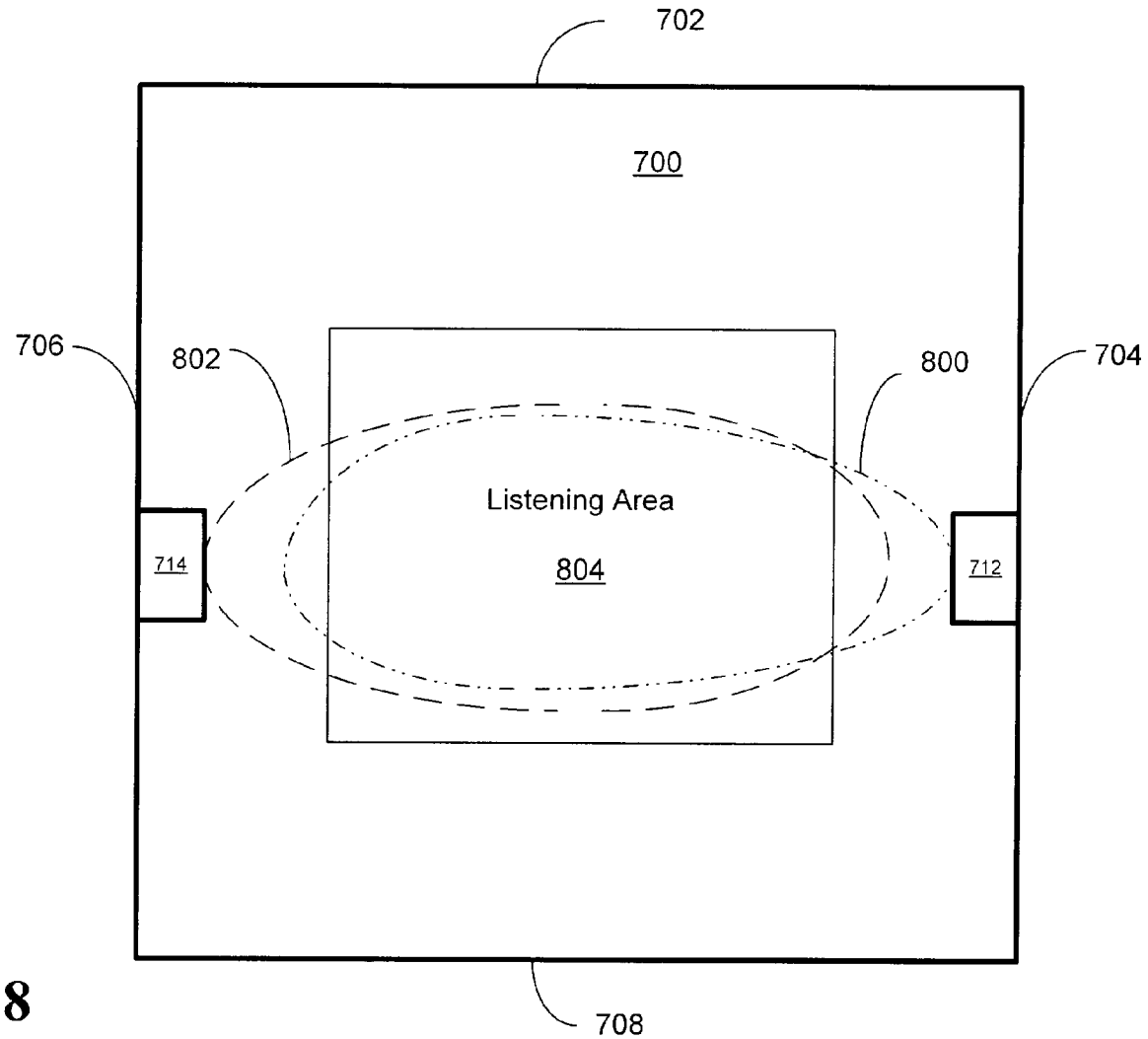
FIG. 8 is a top view of a loudspeaker layout in a typical home theater environment in direct radiation mode.

In DIRECT mode, the right MSRS 712 and left MSRS 714 produce sound in a direct radiating pattern as shown in FIG. 8. The direct radiating pattern includes right sound radiation 800 produced by right MSRS 712 and left sound radiation 802 produced by MSRS 714, both of which overlap over a listening area 804.

The second and third modes of operation are generally known as DIFFUSE modes and are preferably utilized to create a cinema listening sound stage within the listening area. In the DIFFUSE modes, the right MSRS 712 and left MSRS 714 produce sound in a diffuse radiating pattern. There are two types of DIFFUSE modes are generally known as bipole or dipole modes.

Figure 9:
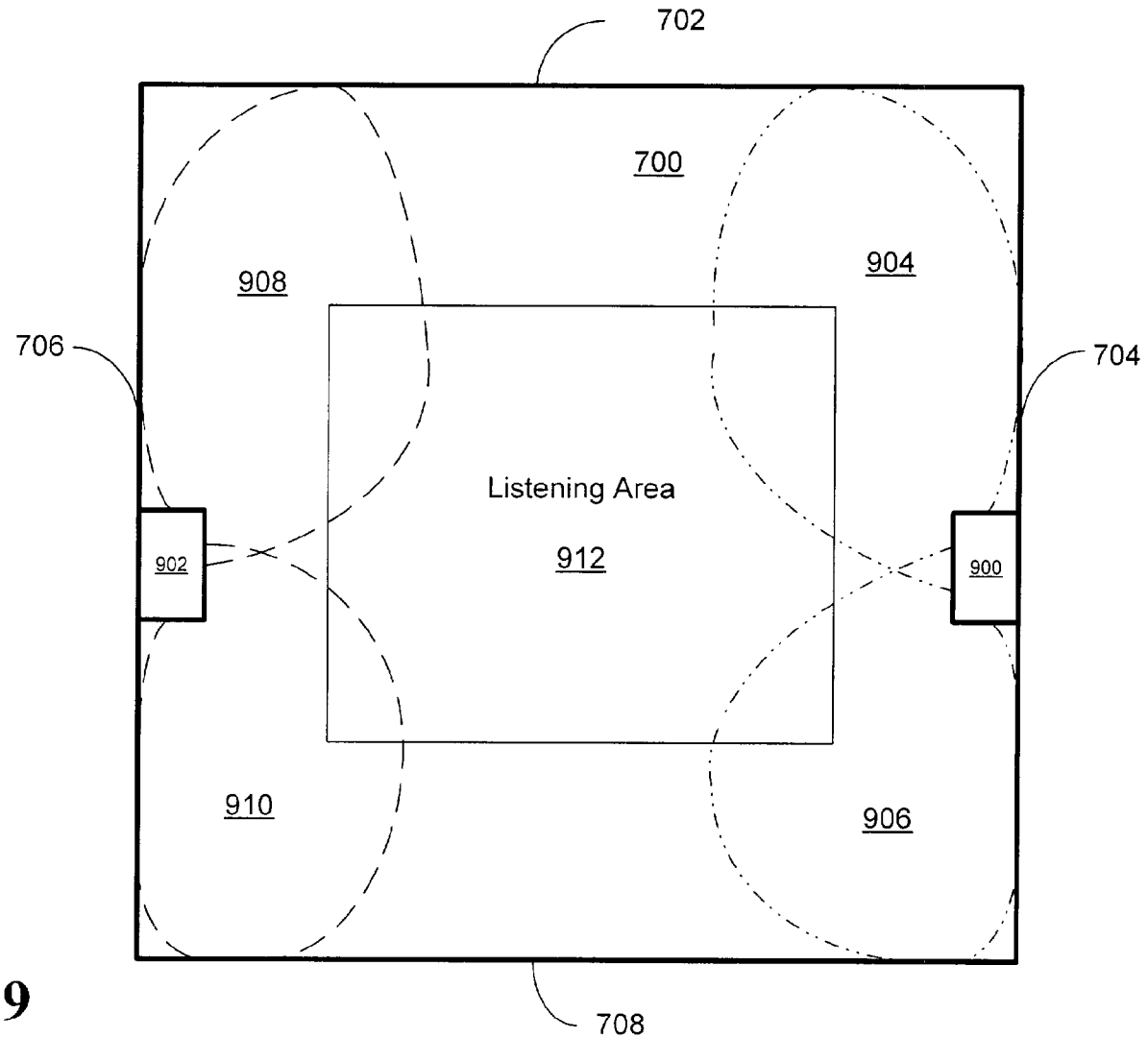
FIG. 9 illustrates an example of a DIFFUSE bipole mode of operation of the MSRS.

FIG. 9 shows an example of a DIFFUSE bipole mode of operation. In FIG. 9, right MSRS 900 and left MSRS 902 produce sound in a diffuse radiating pattern. The diffuse radiating pattern includes right sound radiation front pattern 904 and rear pattern 906 produced by right MSRS 900 and left sound radiation front pattern 908 and rear pattern 910 produced by MSRS 902, both of which overlap over a listening area 912. In a DIFFUSE bipole mode of operation, the right sound radiation front pattern 904 and rear pattern 906 are both in phase and the left sound radiation front pattern 908 and rear pattern 910 are also both in phase.

Figure 10:
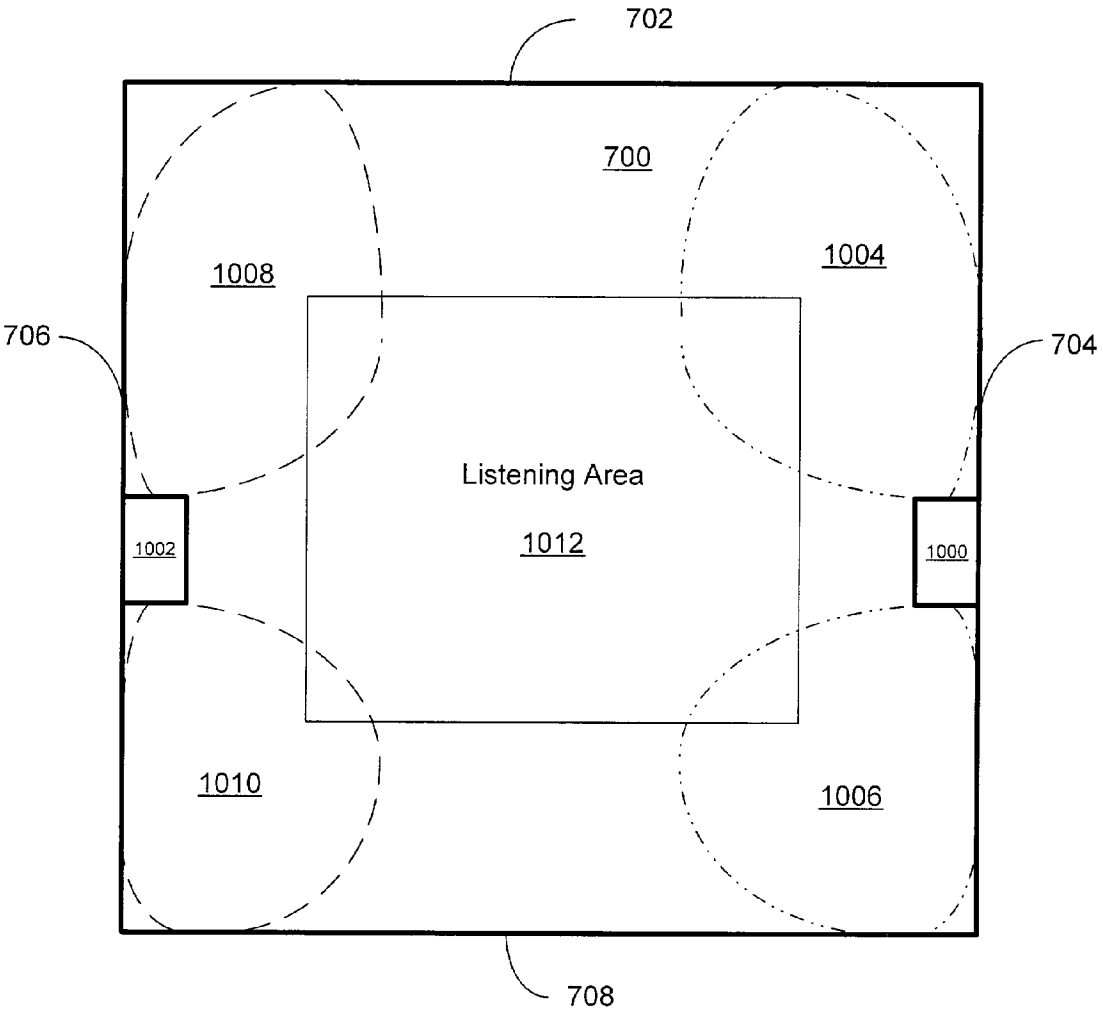
FIG. 10 illustrates an example of a DIFFUSE dipole mode of operation of the MSRS.

FIG. 10 shows an example of a DIFFUSE dipole mode of operation. In FIG. 10, right MSRS 1000 and left MSRS 1002 produce sound in a diffuse radiating pattern. The diffuse radiating pattern includes right sound radiation front pattern 1004 and rear pattern 1006 produced by right MSRS 1000 and left sound radiation front pattern 1008 and rear pattern 1010 produced by MSRS 1002, both of which overlap over a listening area 1012. In a DIFFUSE dipole mode of operation, the right sound radiation front pattern 1004 and rear pattern 1006 are both approximately 180 degrees out of phase and the left sound radiation front pattern 1008 and rear pattern 1010 are also both approximately 180 degrees out of phase.

Figure 11:
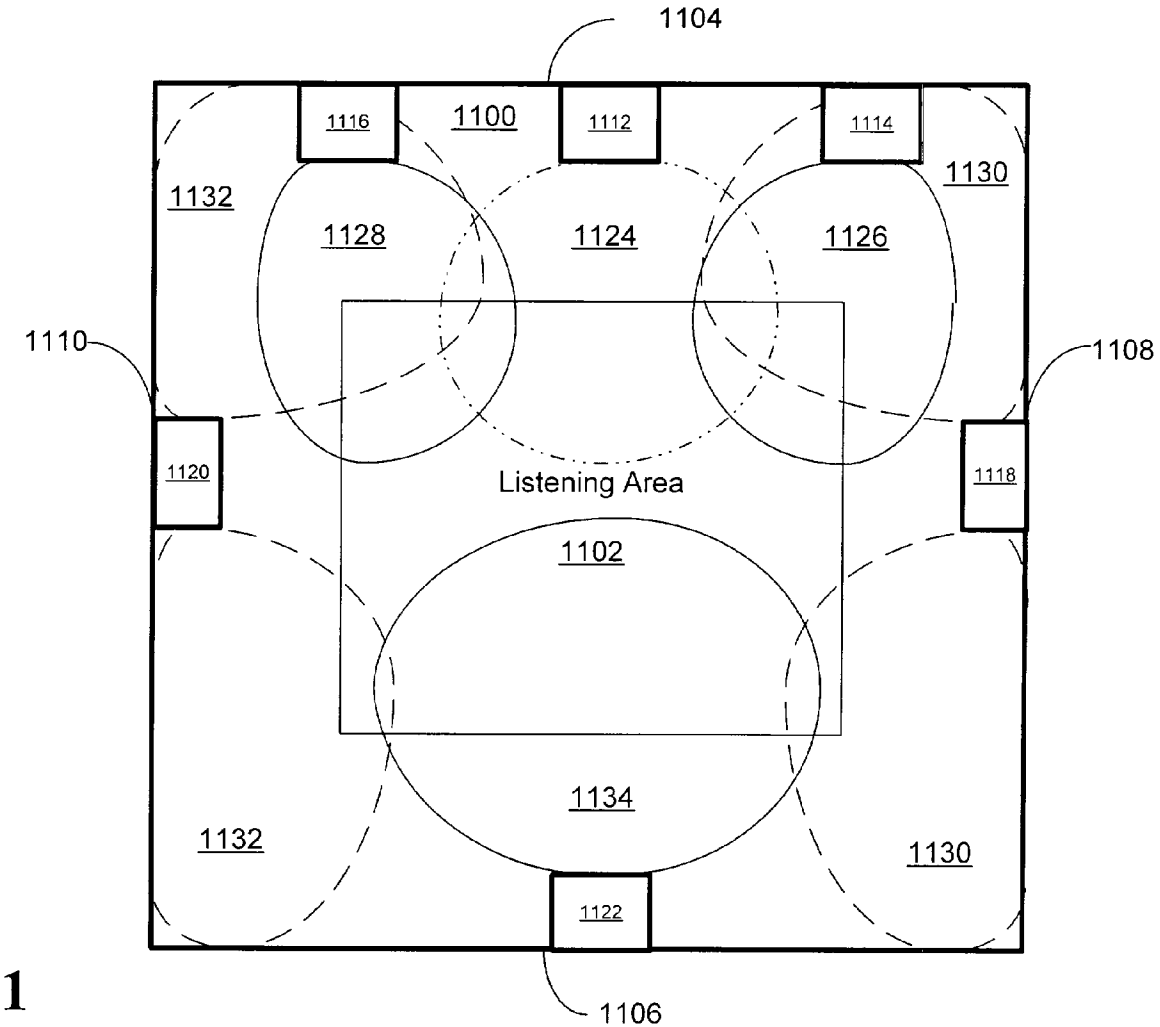
FIG. 11 illustrates a typical 6.1 digital surround sound cinema field implementation.

FIG. 11 shows a typical 6.1 digital surround sound cinema field (such as 6.1 Dolby® stereo, DTS or THX®) implementation in a room 1100 having a listening area 1102, front wall surface 1104, rear wall surface 1106, right side wall surface 1108 and left side wall surface 1110. The 6.1 digital surround sound cinema field is created by seven loudspeakers including center channel loudspeaker 1112, right channel loudspeaker 1114, left channel loudspeaker 1116, right surround speaker 1118, left surround speaker 1120, rear channel speaker 1122 and a sub-woofer (not shown). The loudspeaker produce sound radiation patterns 1124, 1126, 1128, 1130, 1132 and 1134, respectively, all of which overlap the listening area 1102.

Figure 12:
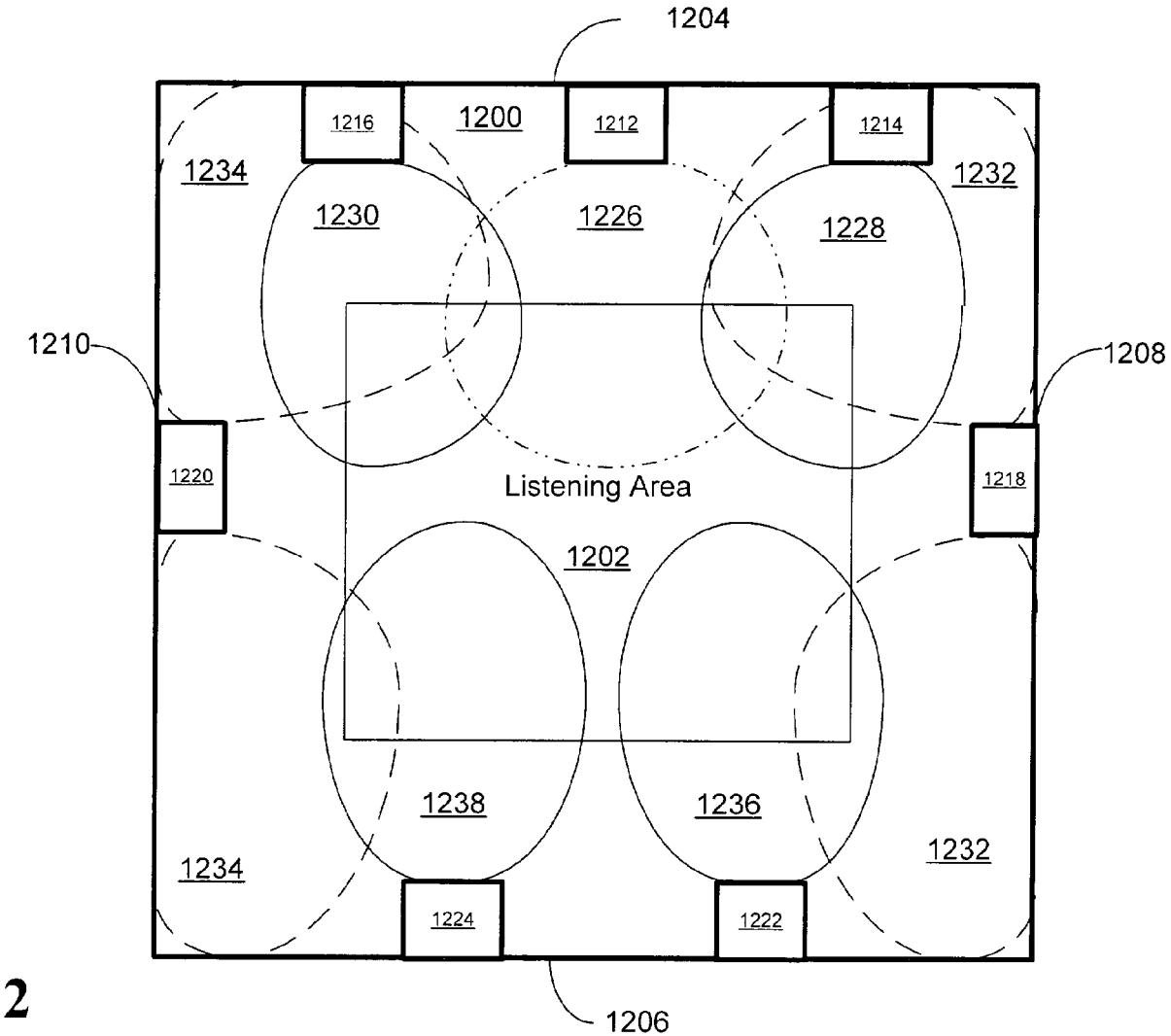
FIG. 12 illustrates a typical 7.1 digital surround sound cinema field implementation.

Similarly, FIG. 12 shows a typical 7.1 digital surround sound cinema field (such as 7.1 DTS-ES or THX®) implementation in a room 1200 having a listening area 1202, front wall surface 1204, rear wall surface 1206, right side wall surface 1208 and left side wall surface 1210. The 7.1 digital surround sound cinema field is created by seven loudspeakers including center channel loudspeaker 1212, right channel loudspeaker 1214, left channel loudspeaker 1216, right surround speaker 1218, left surround speaker 1220, rear right channel speaker 1222, rear left channel speaker 1224 and a sub-woofer (not shown). The loudspeaker produce sound radiation patterns 1226, 1228, 1230, 1232, 1234, 1236 and 1238, respectively, all of which overlap the listening area 1202.

Another aspect of the MSRS 900, FIG. 9, is that it may also operate in a dual drive mode within the DIFFUSE bipole mode of operation. The MSRS 900 may be dual driven with two amplifier channels (in bipole mode only) to provide both side and rear channels from one position in the room. As a result, a pair of MSRS 900 may be utilized to create a 6.1 or 7.1 digital surround sound cinema sound field in the theater environment room 700.

Figure 13:
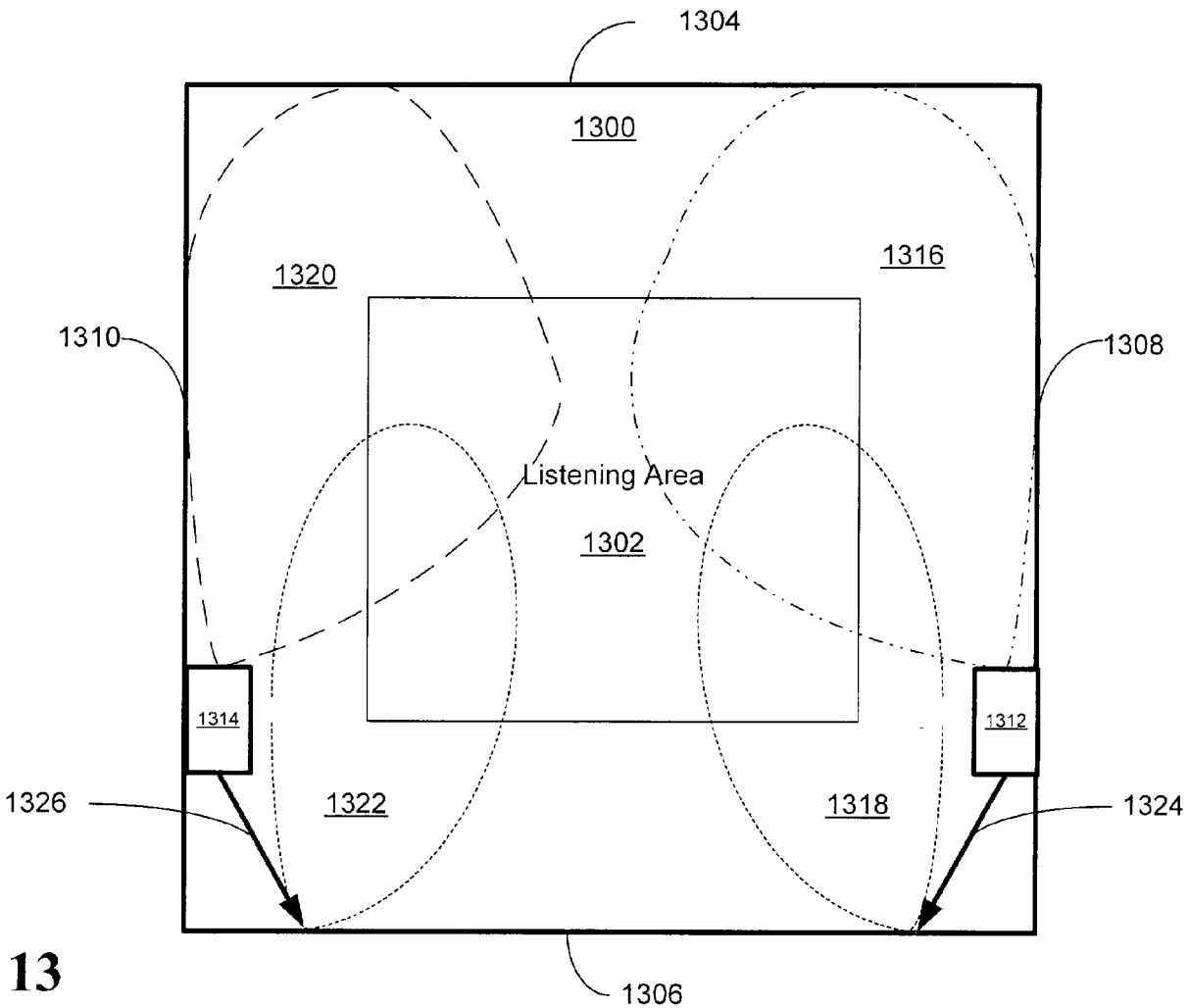
FIG. 13 illustrates an example of a dual drive mode within the DIFFUSE bipole mode of operation of the MSRS.

FIG. 13 shows an example of a dual drive mode within the DIFFUSE bipole mode of operation in a theater environment room 1300 having a listening area 1302, front wall surface 1304, rear wall surface 1306, right side wall surface 1308 and left side wall surface 1310. In FIG. 13, right MSRS 1312 and left MSRS 1314 produce sound in a diffuse radiating pattern.

However, unlike the implementation shown in FIG. 9, in this example implementation both the right MSRS 1312 and left MSRS 1314 are placed relatively close to the rear wall surface 1306 and are dual driven with two separate amplification channels. As a result, right MSRS 1312 and left MSRS 1314 produce sound radiation patterns 1316, 1318, 1320 and 1322, respectively.

Sound radiation patterns 1320 and 1322 are created by driving right MSRS 1312 and left MSRS 1314 in dual mode. As such the sound radiation pattern 1316 corresponds to the information signal received on one channel at right MSRS 1312 and sound radiation pattern 1318 corresponds to the information signal received on a second channel at right MSRS 1312 that is directed 1324 towards the rear wall surface 1306. Similarly, the sound radiation pattern 1320 corresponds to the information signal received on one channel at left MSRS 1314 and sound radiation pattern 1322 corresponds to the information signal received on a second channel at left MSRS 1314 that is directed 1326 towards the rear wall surface 1306.

The result is that right MSRS 1312 is able to produce the same type of sound radiation patterns as the 6.1 digital surround sound patterns 1130, FIG. 11, and 1134 or the 7.1 digital surround sound patterns 1230, FIG. 12, and 1236 without the need for loudspeakers 1122, FIG. 11, and 1222, FIG. 12, respectively. Similarly, left MSRS 1312 is able to produce the same type of sound radiation patterns as the 6.1 digital surround sound patterns 1132, FIG. 1, and 1134 or the 7.1 digital surround sound patterns 1234, FIG. 12, and 1238 without the need for loudspeakers 1122, FIG. 11, and 1224, FIG. 12, respectively.

Other example implementations may include utilizing the MSRS 102, FIG. 1, as an in-wall or in-ceiling solution. In these types of implementation the sound array 202, FIG. 2 may be implemented in an off angle sound firing position to create an approximately unobstructed DIFFUSE mode of operation.

Figure 14:
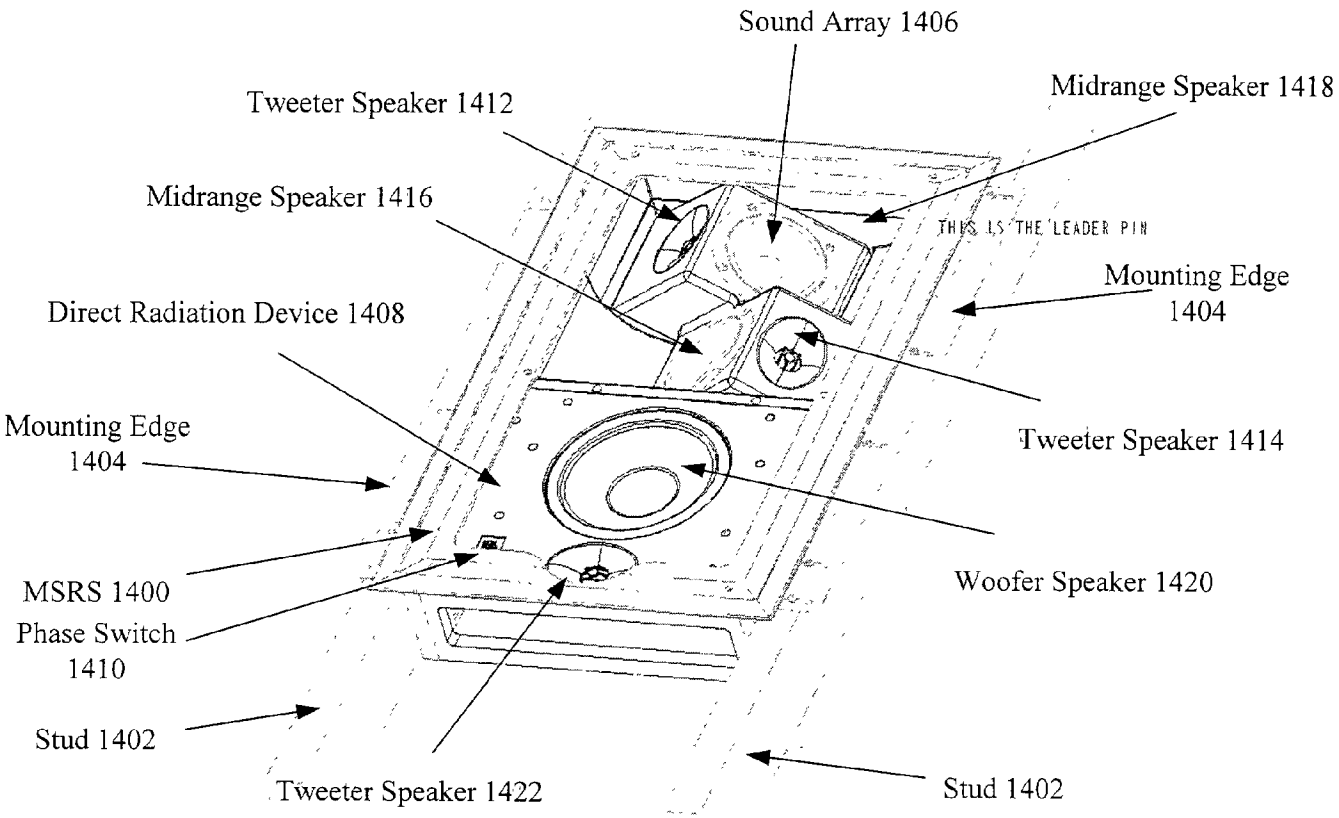
FIG. 14 is a perspective view illustrating an example implementation of an in-wall or in-ceiling MSRS.

In FIG. 14 an example implementation of an in-wall or in-ceiling MSRS 1400 on wall or ceiling studs 1402 is shown. The MSRS 1400 is secured to the studs 1402 flush to the wall or ceiling surface via mounting edges 1404. The MSRS 1400 may be a Synthesis S4A loudspeaker from JBL, Inc., a subsidiary of Harman International, Inc., of Northridge, Calif.

The MSRS 1400 may include an off angle sound array 1406, a direct radiation device 1408 and a control device (not shown). The off angle sound array 1406 may include a pair of side firing arrays that have a phase switch 1410 for 0 or 180 degrees to allow polarity to be changed from the front of a baffle (not shown). Additionally, an installer may choose between dipole or bipole mode manually during installation of the MSRS 1400 or it may be switched automatically through another control input (not shown). The phase switch 1410 would reverse the phase on the midranges in dipole mode.

There are two arrays per off angle sound array 1406. Each array may contain a one-inch aquaplas-coated titanium dome tweeter (1412 and 1414) and four-inch midrange set (1416 and 1418) in an angled recess, with an EOS™ Waveguide for the tweeter (1412 and 1414).

The direct radiation device 1408 may include an eight-inch dual-voice-coil woofer 1420 for a low frequency driver and a third direct-radiating tweeter 1422. The control device (not shown) may be voltage (such as a 5 or 12 volts direct current relay input) trigger that switches the MSRS 1400 between a direct radiating 2-way eight-inch loudspeaker for music decoding modes and a diffuse radiating surround sound loudspeaker (either bipole or dipole) for cinema decoding modes.

The MSRS 1400 may include numerous crossover networks (not shown) with corresponding crossover frequencies to produce the proper sound field in each mode of operation. In an example implementation, the MSRS 1400 may include three crossover networks with crossover frequencies of approximately 400 Hz for bipole mode, 800 Hz and 3.6 kHz for dipole mode and 2.5 kHz for direct mode. In this example implementation, the MSRS 1400 may produce a frequency response of 80 Hz to 20 kHz with a sensitivity of 90 dB.

As a result, the MSRS 1400 may operate as three-way loudspeaker in bipole mode with two crossover points of approximately 500 Hz to 600 Hz from the midrange to woofer and approximately 3 kHz from the tweeter to midrange. The MSRS 1400 may also operate as a two-way loudspeaker in dipole mode with crossover point of approximately 400 Hz for the dipole midrange to woofer. Additionally, the MSRS 1400 may also operate as a two-way loudspeaker in direct mode operation with a crossover point of approximately 2.5 kHz.

The MSRS 1400 may be installed into a standard construction (such as 16 inch on center two-inch by four-inch stud walls) with a grill (not shown) that fits flush to the wall surface. The MSRS 1400 would also fit into standard drop ceiling such as two-inch by two-inch tile locations.

Figure 15:
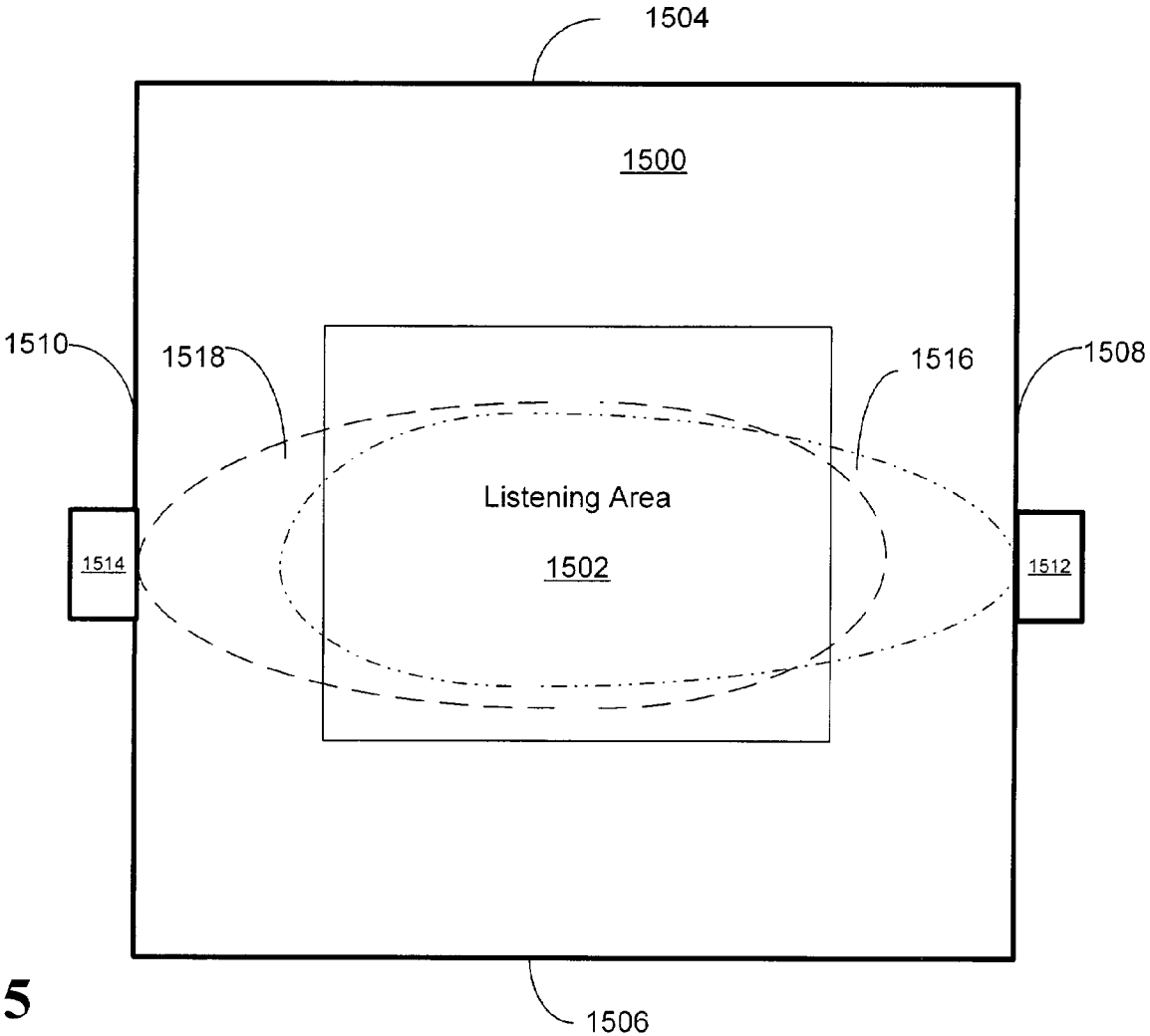
FIG. 15 is a top view of a in-wall loudspeaker layout operating in DIRECT mode in a home theater environment room.

In FIG. 15, a top view of a in-wall loudspeaker layout operating in DIRECT mode in a home theater environment room 1500 having a listening area 1502 and four wall surfaces including front wall surface 1504, right wall surface 1506, left wall surface 1508 and rear wall surface 1510 is shown. A right MSRS 1512 and left MSRS 1514 are located in and are flush with the right wall surface 1506 and left wall surface 1508, respectively. Similar to FIG. 8, in DIRECT mode, the right MSRS 1512 and left MSRS 1514 produce sound in a direct radiating pattern that includes right sound radiation 1516 produced by right MSRS 1512 and left sound radiation 1518 produced by MSRS 1514, both of which overlap over a listening area 1502.

Figure 16:
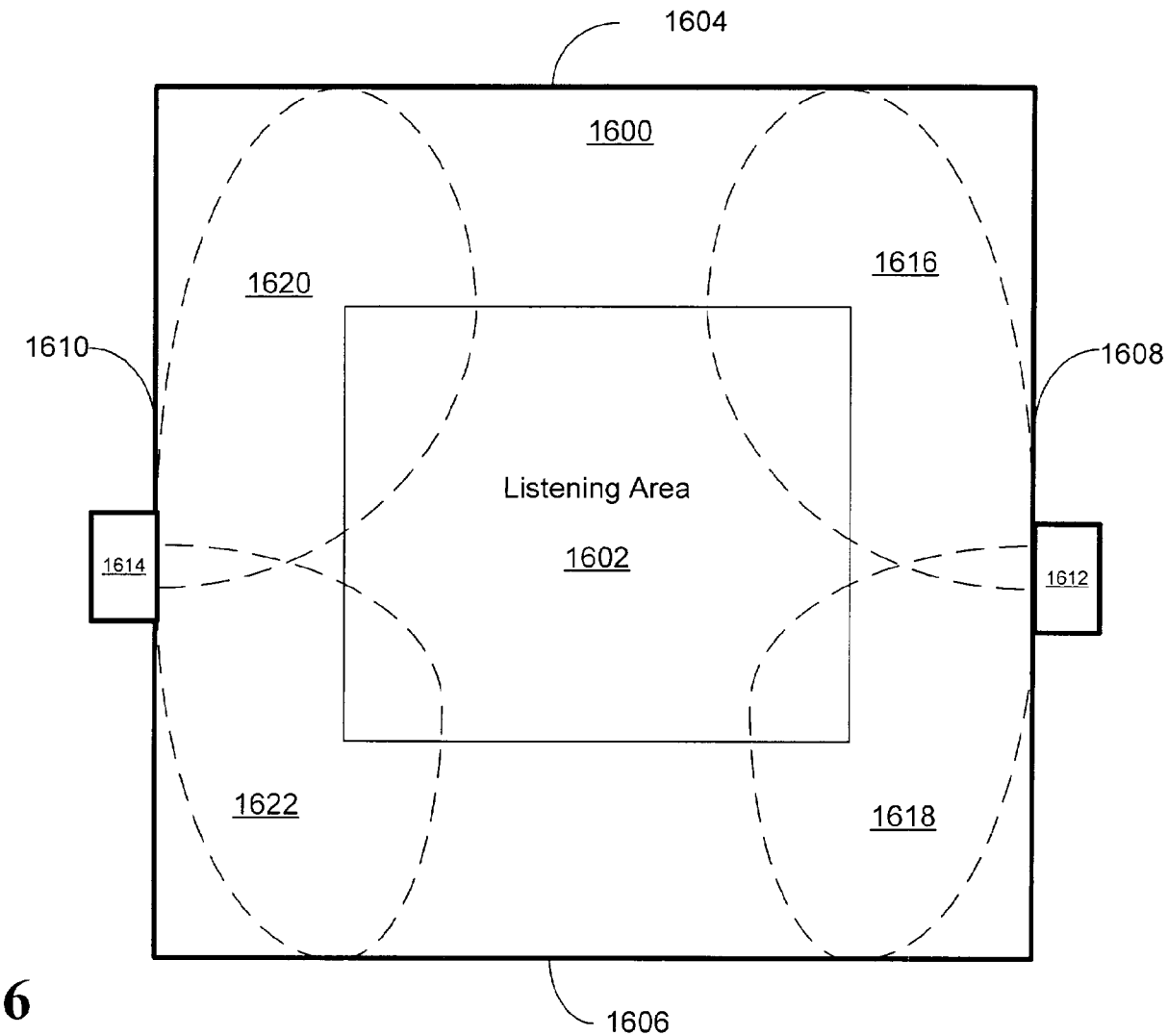
FIG. 16 illustrates an example of a DIFFUSE bipole mode of operation for an in-wall implementation of the MSRS.

FIG. 16 shows an example of a DIFFUSE bipole mode of operation for an in-wall implementation in room 1600 having a listening area 1602 and four wall surfaces including front wall surface 1604, right wall surface 1606, left wall surface 1608 and rear wall surface 1610. In FIG. 16, right MSRS 1612 and left MSRS 1614 are located within and flush wall surfaces 1606 and 1608, respectively, and produce sound in a diffuse radiating pattern. The diffuse radiating pattern includes right sound radiation front pattern 1616 and rear pattern 1618 produced by right MSRS 1612 and left sound radiation front pattern 1620 and rear pattern 1622 produced by left MSRS 1614, both of which overlap over a listening area 1602. In a DIFFUSE bipole mode of operation, the right sound radiation front pattern 1616 and rear pattern 1618 are both in phase and the left sound radiation front pattern 1620 and rear pattern 1622 are also both in phase.

Figure 17:
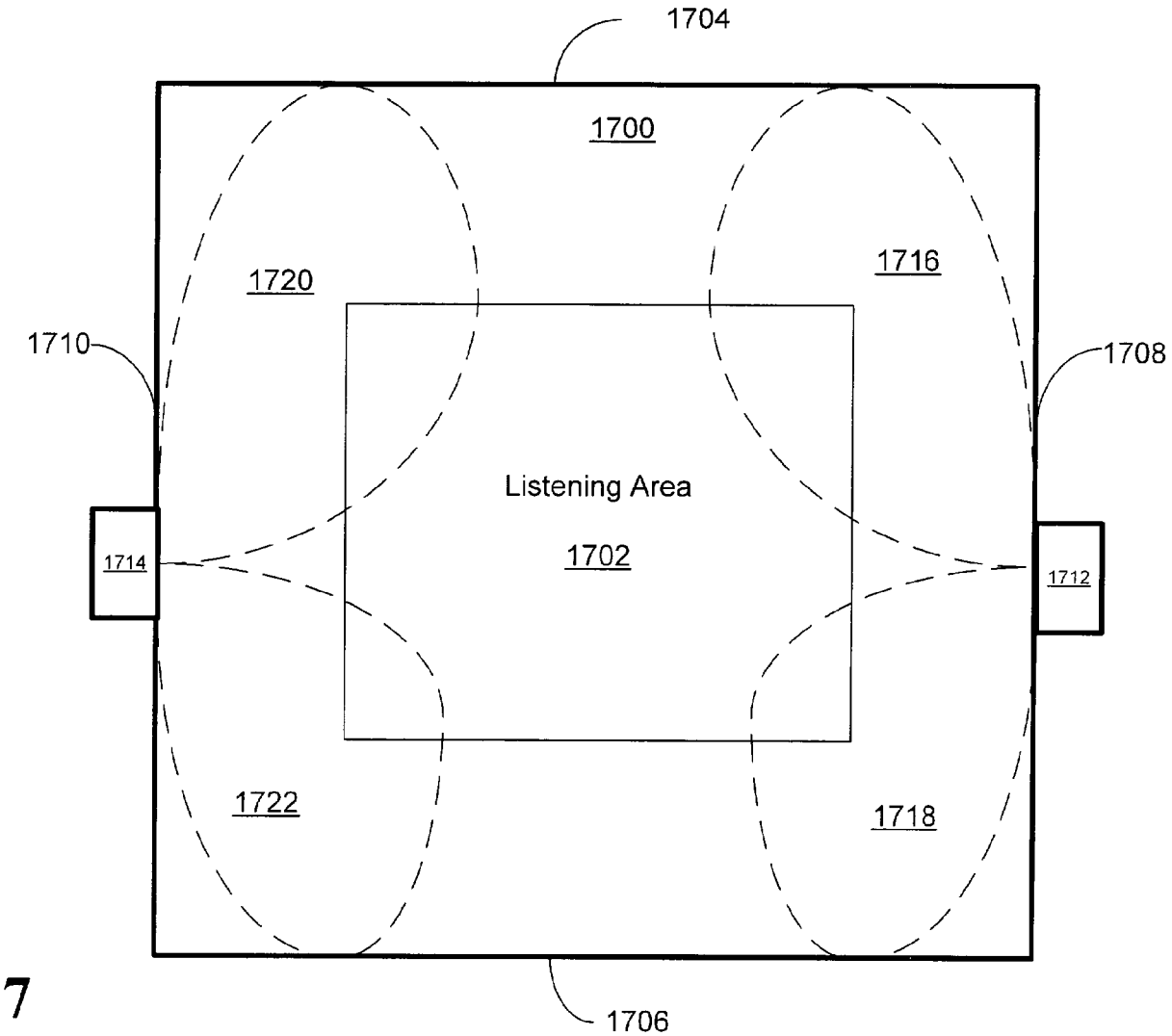
FIG. 17 illustrates an example of a DIFFUSE dipole mode of operation for an in-wall implementation of the MSRS.

FIG. 17 shows an example of a DIFFUSE dipole mode of operation for an in-wall implementation in room 1700 having a listening area 1702 and four wall surfaces including front wall surface 1704, right wall surface 1706, left wall surface 1708 and rear wall surface 1710. In FIG. 17, right MSRS 1712 and left MSRS 1714 produce sound in a diffuse radiating pattern. In FIG. 17, right MSRS 1712 and left MSRS 1714 are located within and flush wall surfaces 1706 and 1708, respectively, and produce sound in a diffuse radiating pattern. The diffuse radiating pattern includes right sound radiation front pattern 1716 and rear pattern 1718 produced by right MSRS 1712 and left sound radiation front pattern 1720 and rear pattern 1722 produced by left MSRS 1714, both of which overlap over a listening area 1702. In a DIFFUSE dipole mode of operation, the right sound radiation front pattern 1716 and rear pattern 1718 are both approximately 180 degrees out of phase and the left sound radiation front pattern 1720 and rear pattern 1722 are also both approximately 180 degrees out of phase.

Figure 18:
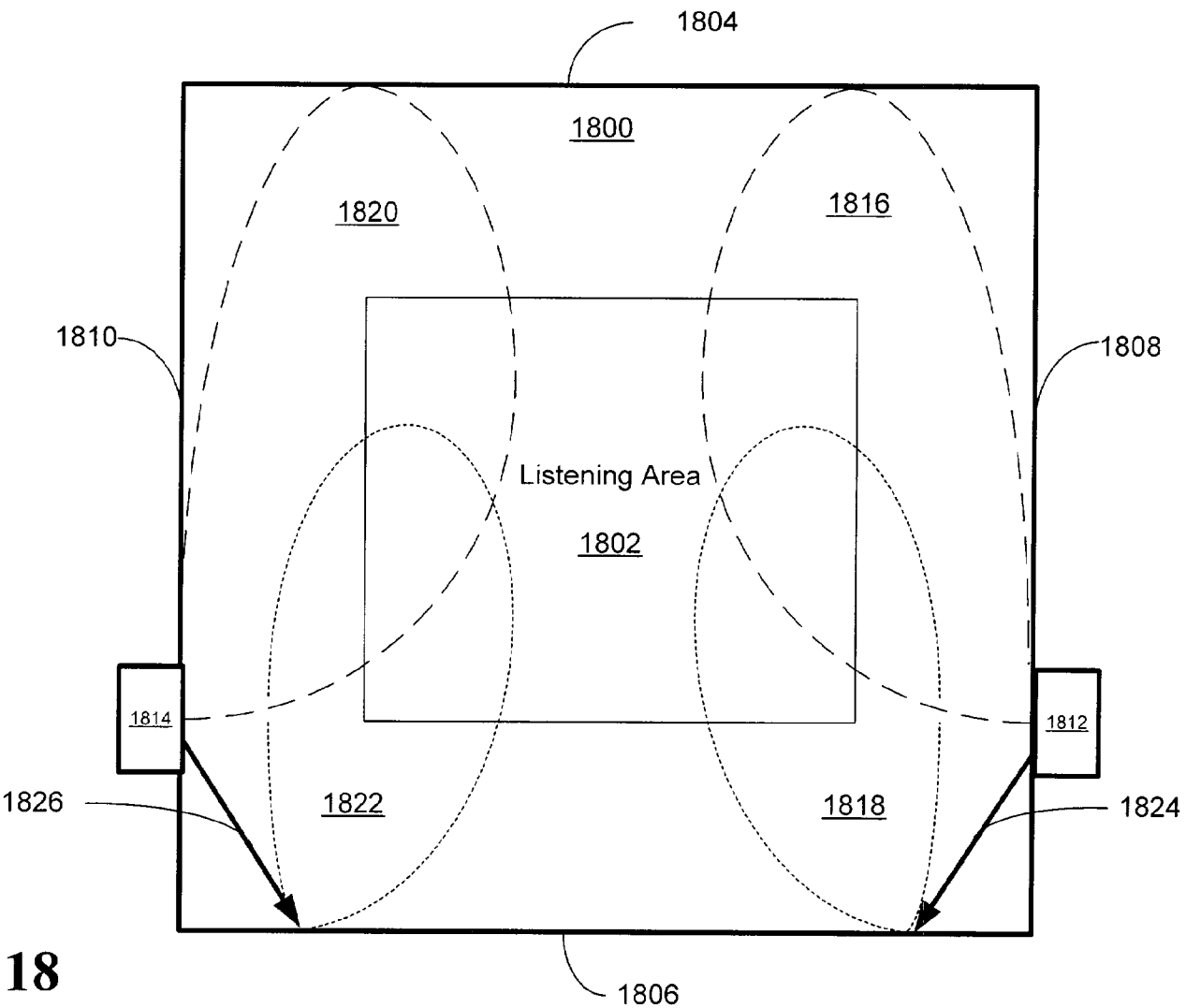
FIG. 18 illustrates an example of a dual drive mode within the DIFFUSE bipole mode of operation for an in-wall implementation of the MSRS.

FIG. 18 shows an example of a dual drive mode within the DIFFUSE bipole mode of operation in a theater environment room 1800 having a listening area 1802, front wall surface 1804, rear wall surface 1806, right side wall surface 1808 and left side wall surface 1810. In FIG. 18, right MSRS 1812 and left MSRS 1814 are located within and flush with wall surfaces 1808 and 1810, respectively, and produce sound in a diffuse radiating pattern.

Sound radiation patterns 1820 and 1822 are created by driving right MSRS 1812 and left MSRS 1814 in dual mode. As such the sound radiation pattern 1816 corresponds to the information signal received on one channel at right MSRS 1812 and sound radiation pattern 1818 corresponds to the information signal received on a second channel at right MSRS 1812 that is directed 1824 towards the rear wall surface 1806. Similarly, the sound radiation pattern 1820 corresponds to the information signal received on one channel at left MSRS 1814 and sound radiation pattern 1822 corresponds to the information signal received on a second channel at left MSRS 1814 that is directed 1826 towards the rear wall surface 1806.

Figure 19:
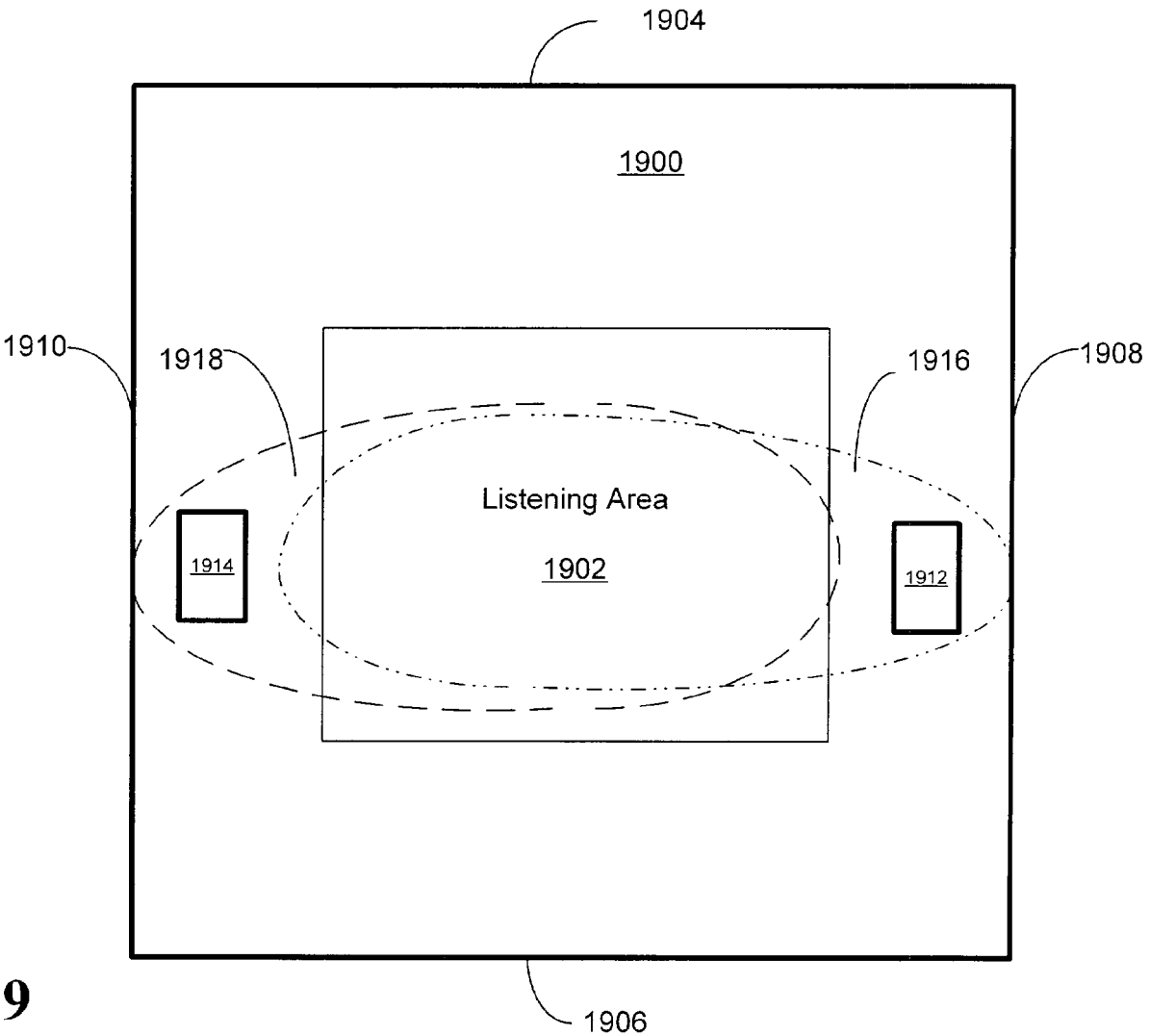
FIG. 19 is a top view of an in-ceiling loudspeaker layout operating in DIRECT mode in a home theater environment room.

In FIG. 19, a top view of a in-ceiling loudspeaker layout operating in DIRECT mode in a home theater environment room 1900 having a listening area 1902 and four wall surfaces including front wall surface 1904, right wall surface 1906, left wall surface 1908 and rear wall surface 1910 is shown. A right MSRS 1912 and left MSRS 1914 are located in and are flush with the ceiling surface (not shown). Similar to FIG. 15, in DIRECT mode, the right MSRS 1912 and left MSRS 1914 produce sound in a direct radiating pattern that includes right sound radiation 1916 produced by right MSRS 1912 and left sound radiation 1918 produced by MSRS 1914, both of which overlap over a listening area 1902.

Figure 20:
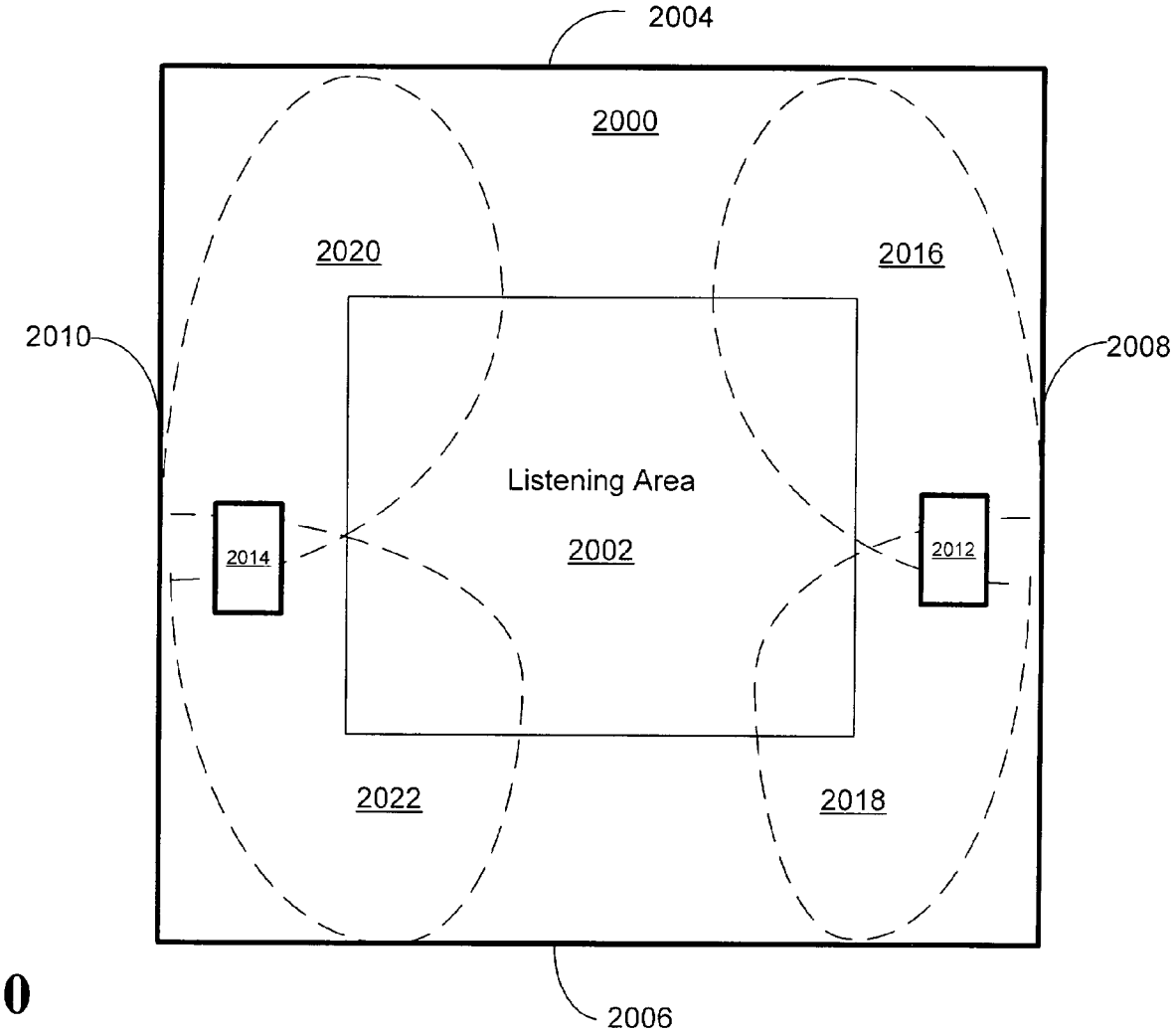
FIG. 20 illustrates an example of a DIFFUSE bipole mode of operation for an in-ceiling implementation of the MSRS.

FIG. 20 shows an example of a DIFFUSE bipole mode of operation for an in-ceiling implementation in room 2000 having a listening area 2002 and four wall surfaces including front wall surface 2004, right wall surface 2006, left wall surface 2008 and rear wall surface 2010. In FIG. 20, right MSRS 2012 and left MSRS 2014 are located within and flush ceiling surface (not shown), respectively, and produce sound in a diffuse radiating pattern. The diffuse radiating pattern includes right sound radiation front pattern 2016 and rear pattern 2018 produced by right MSRS 2012 and left sound radiation front pattern 2020 and rear pattern 2022 produced by left MSRS 2014, both of which overlap over a listening area 2002. In a DIFFUSE bipole mode of operation, the right sound radiation front pattern 2016 and rear pattern 2018 are both in phase and the left sound radiation front pattern 2020 and rear pattern 2022 are also both in phase.

Figure 21:
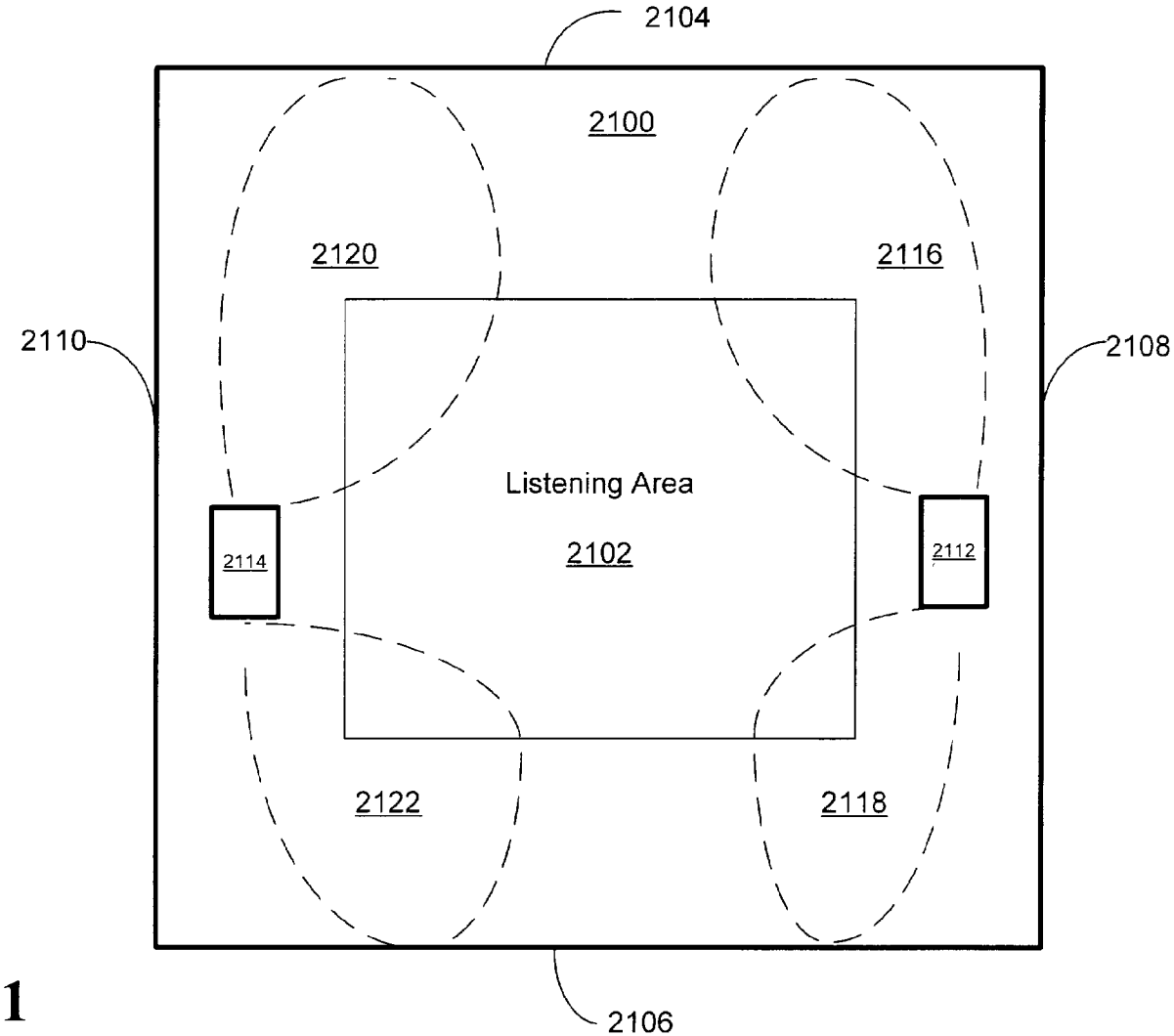
FIG. 21 illustrates an example of a DIFFUSE dipole mode of operation for an in-ceiling implementation of the MSRS.

FIG. 21 shows an example of a DIFFUSE dipole mode of operation for an in-ceiling implementation in room 2100 having a listening area 2102 and four wall surfaces including front wall surface 2104, right wall surface 2106, left wall surface 2108 and rear wall surface 2110. In FIG. 21, right MSRS 2112 and left MSRS 2114 produce sound in a diffuse radiating pattern. In FIG. 21, right MSRS 2112 and left MSRS 2114 are located within and flush with the ceiling (not shown) and produce sound in a diffuse radiating pattern. The diffuse radiating pattern includes right sound radiation front pattern 2116 and rear pattern 2118 produced by right MSRS 2112 and left sound radiation front pattern 2120 and rear pattern 2122 produced by MSRS 2112, both of which overlap over a listening area 2102. In a DIFFUSE dipole mode of operation, the right sound radiation front pattern 2116 and rear pattern 2118 are both approximately 180 degrees out of phase and the left sound radiation front pattern 2120 and rear pattern 2122 are also both approximately 180 degrees out of phase.

Figure 22:
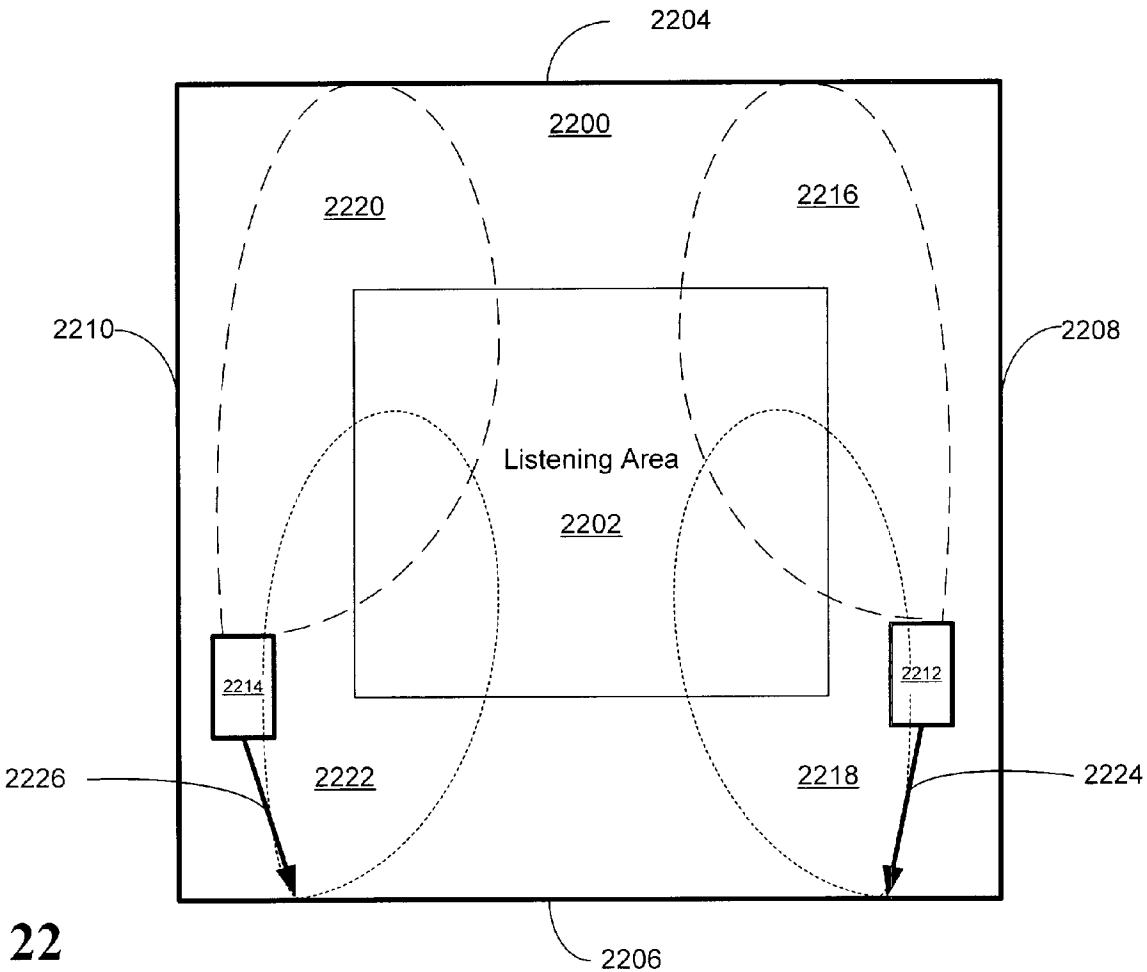
FIG. 22 illustrates an example of a dual drive mode within the DIFFUSE bipole mode of operation for an in-ceiling implementation of the MSRS.

FIG. 22 shows an example of a dual drive mode within the DIFFUSE bipole mode of operation in a theater environment room 2200 having a listening area 2202, front wall surface 2204, rear wall surface 2206, right side wall surface 2208 and left side wall surface 2210. In FIG. 22, right MSRS 2212 and left MSRS 2214 are located within and flush within the ceiling surface (not shown) and produce sound in a diffuse radiating pattern.

Sound radiation patterns 2220 and 2222 are created by driving right MSRS 2212 and left MSRS 2214 in dual mode.

As such the sound radiation pattern 2216 corresponds to the information signal received on one channel at right MSRS 2212 and sound radiation pattern 2218 corresponds to the information signal received on a second channel at right MSRS 2212 that is directed 2224 towards the rear wall surface 2206. Similarly, the sound radiation pattern 2220 corresponds to the information signal received on one channel at left MSRS 2214 and sound radiation pattern 2222 corresponds to the information signal received on a second channel at left MSRS 2214 that is directed 2226 towards the rear wall surface 2206.

Figure 23:
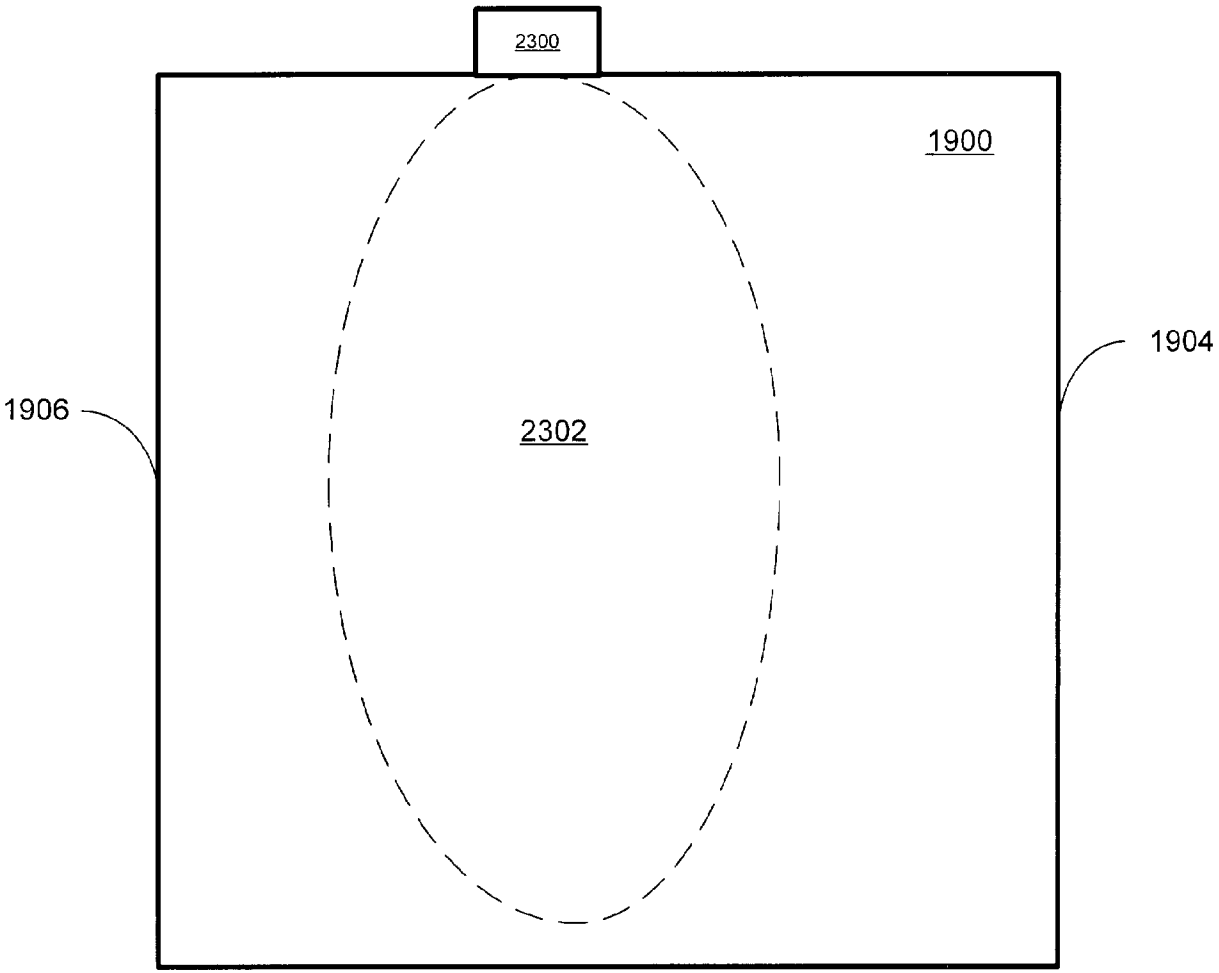
FIG. 23 is a side view of an implementation of an in-ceiling MSRS layout operating in DIRECT mode for a home theater environment room.
Figure 24:
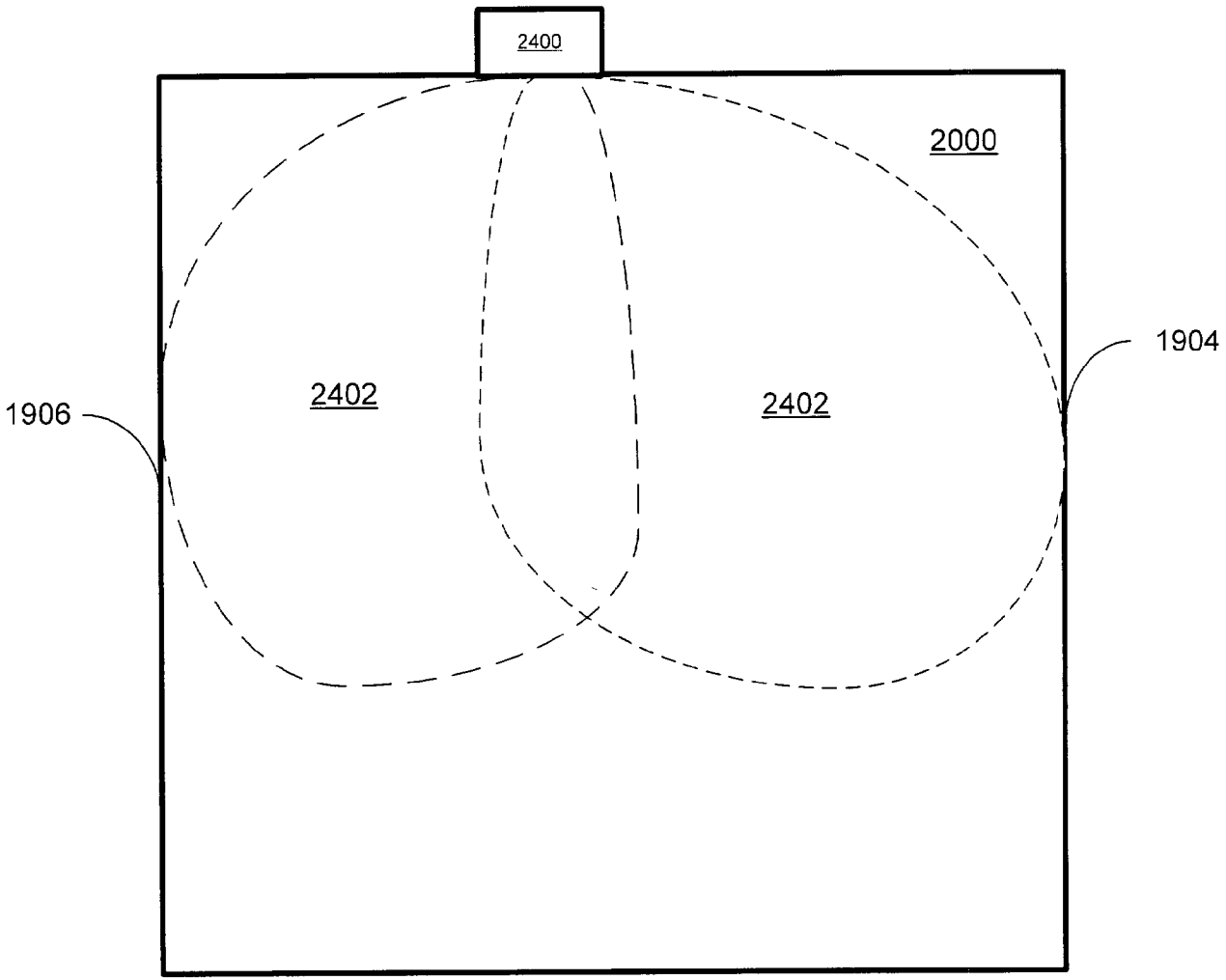
FIG. 24 illustrates a side view of an implementation of a DIFFUSE bipole mode of operation for an in-ceiling implementation MSRS in the home theater environment room.
Figure 25:
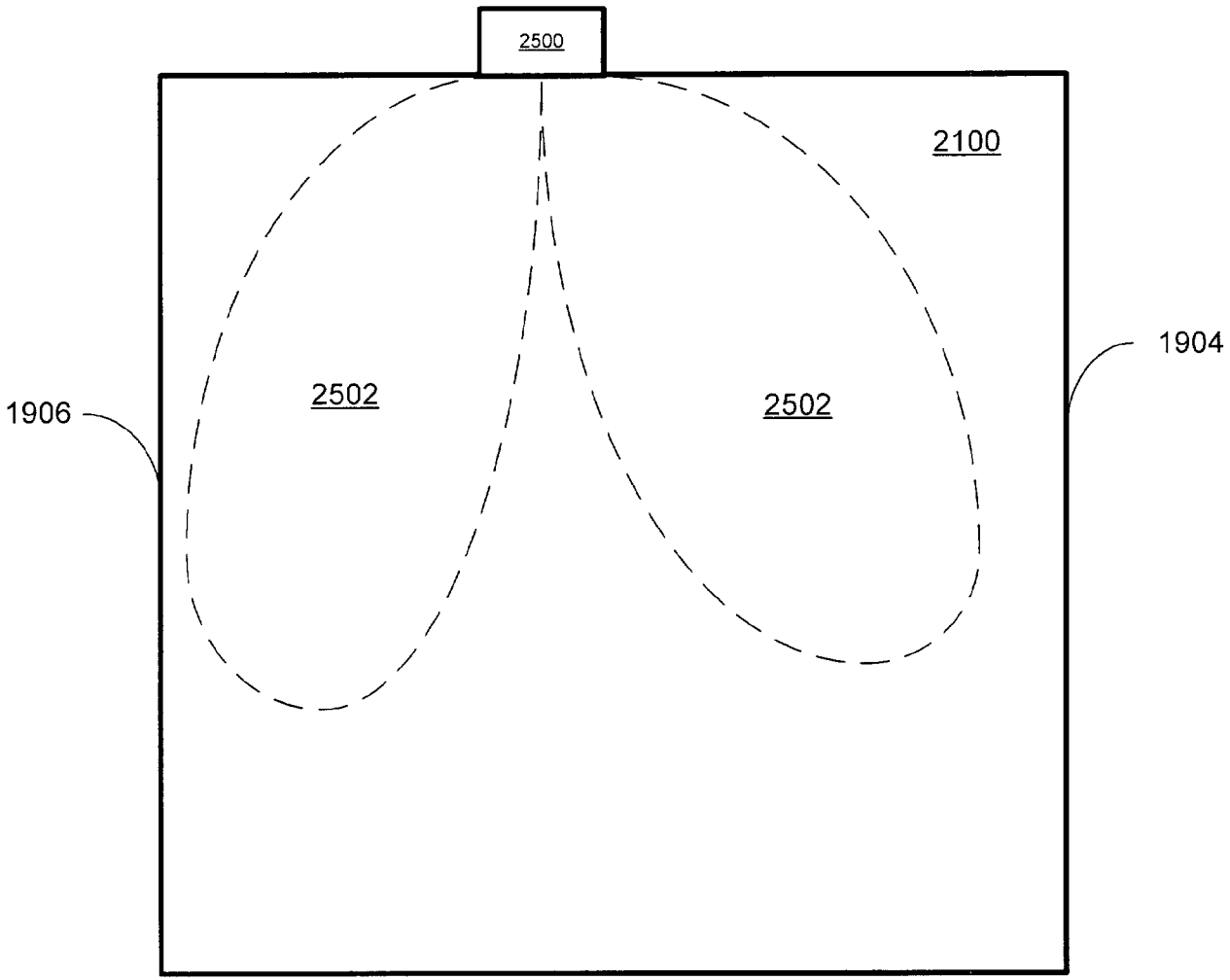
FIG. 25 is a side view of an implementation of a DIFFUSE dipole mode of operation for an in-ceiling implementation of the MSRS for a home theater environment room.
Figure 26:
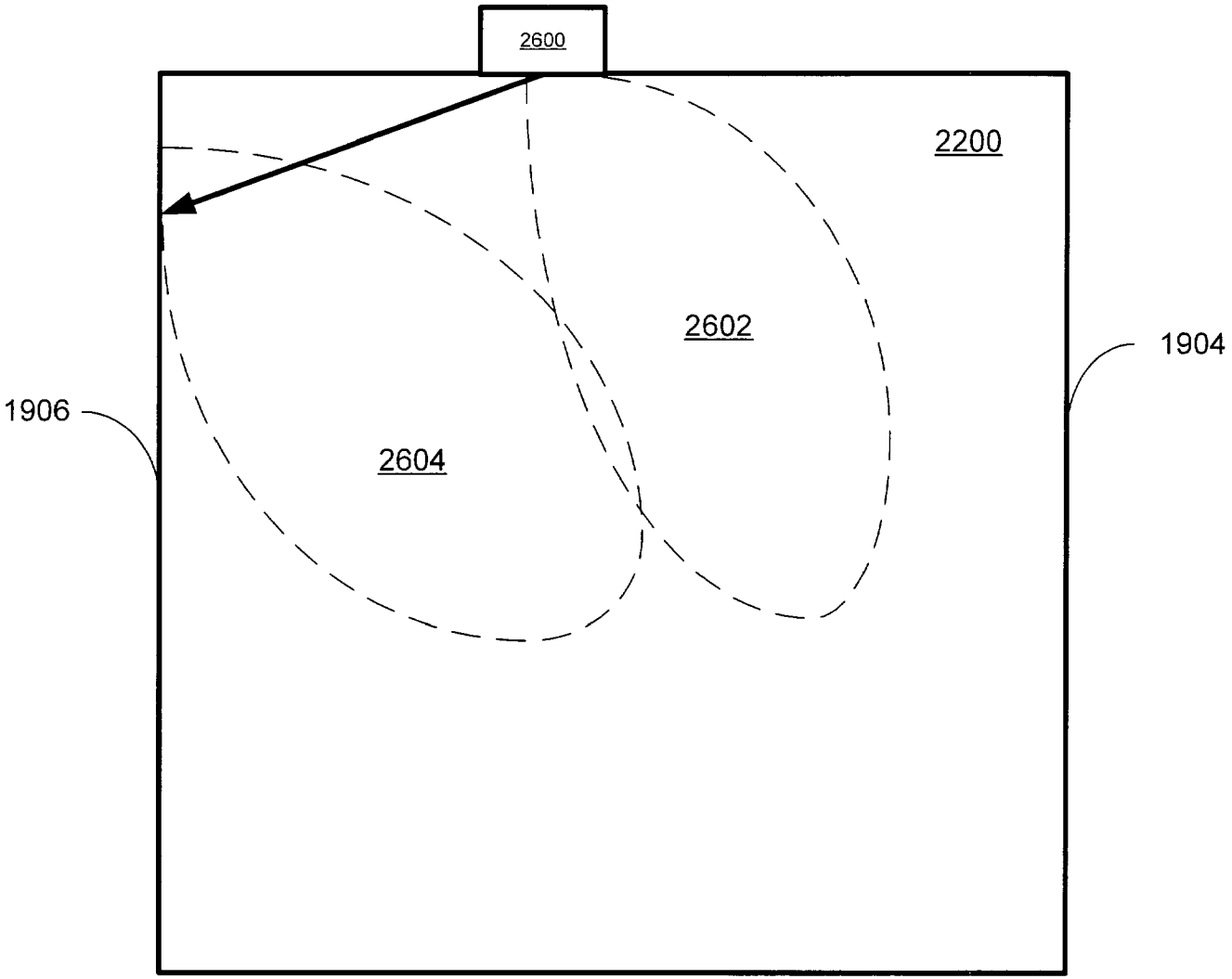
FIG. 26 is a side view of an implementation of an example of a dual drive mode within the DIFFUSE bipole mode of operation for an in-ceiling implementation of the MSRS for a home theater environment room.

FIG. 23 shows a side view of an implementation of a in-ceiling MSRS 2300 layout operating in DIRECT mode in the home theater environment room 1900 with associated sound radiation pattern 2302. FIG. 24 shows a side view of an implementation of a DIFFUSE bipole mode of operation for an in-ceiling implementation MSRS 2400 in the home theater environment room 2000 with associated sound radiation pattern 2402. FIG. 25 a side view of an implementation of a DIFFUSE dipole mode of operation for an in-ceiling implementation in the home theater environment room 2100 with associated sound radiation pattern 2502. FIG. 26 shows a side view of an implementation of an example of a dual drive mode within the DIFFUSE bipole mode of operation in a theater environment room 2200 with associated sound radiation patterns 2602 and 2604.

Figure 27:
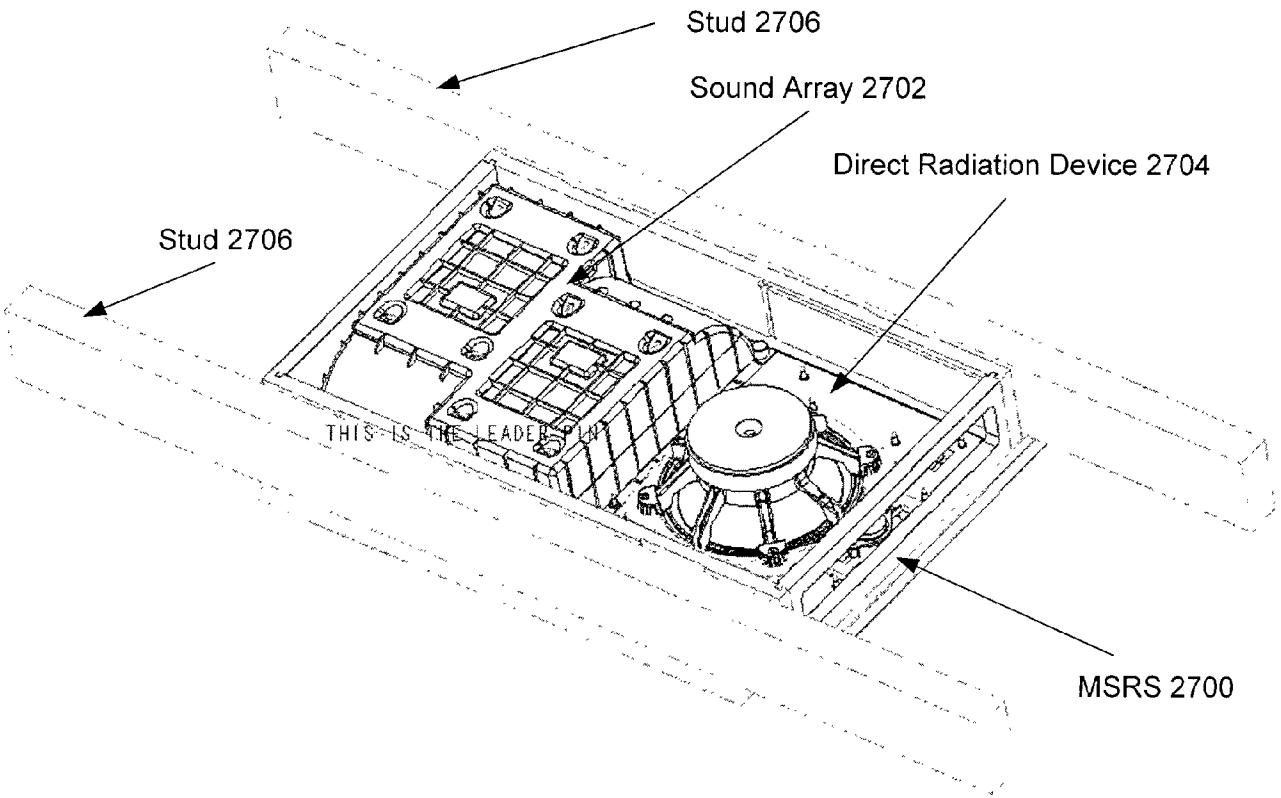
FIG. 27 is a back perspective view illustrating an example implementation of an in-wall or in-ceiling MSRS.
Figure 28:
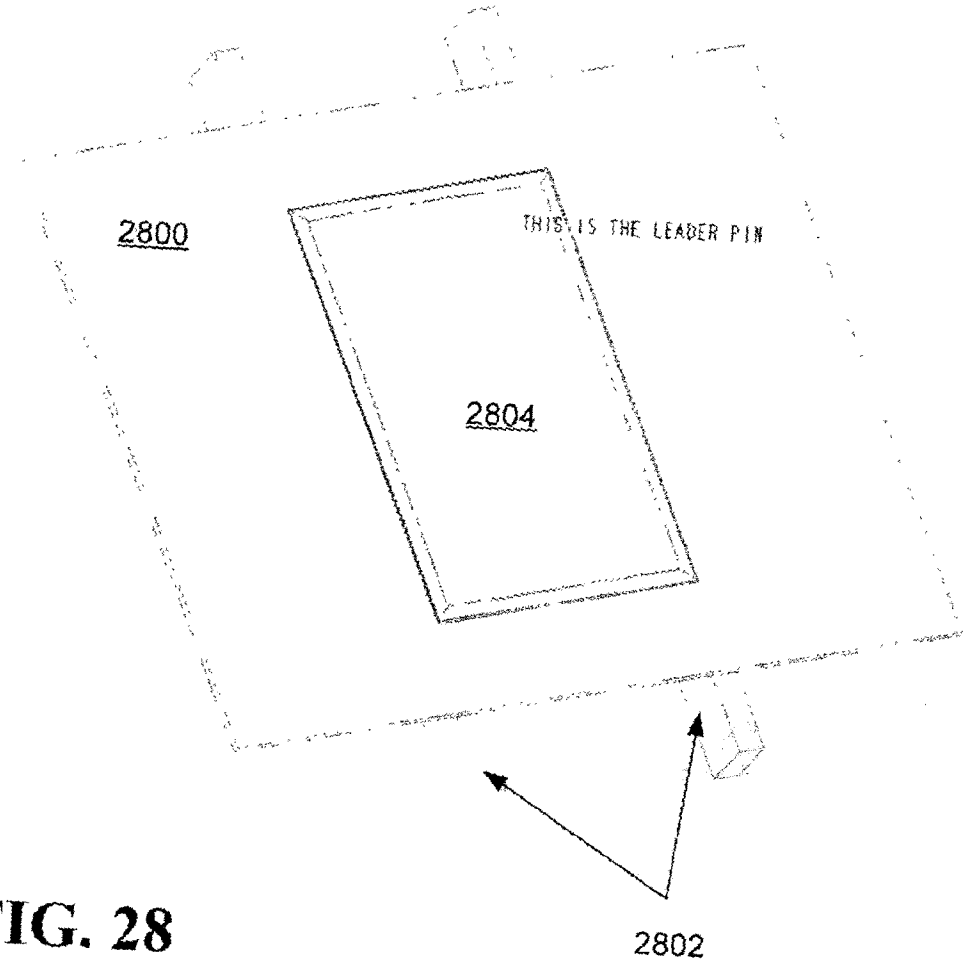
FIG. 28 is a front perspective view of a wall or ceiling surface on studs having an opening for placing in the MSRS flush with surface.

In FIG. 27, a back perspective view of the MSRS 2700 having a sound array 2702 and direct radiation device 2704 is shown attached to either wall or ceiling studs 2706. In FIG. 28, a front perspective view of a wall or ceiling surface 2800 is shown on studs 2802 having an opening 2804 for placing in the MSRS (not shown) flush with surface 2800.

Figure 29:
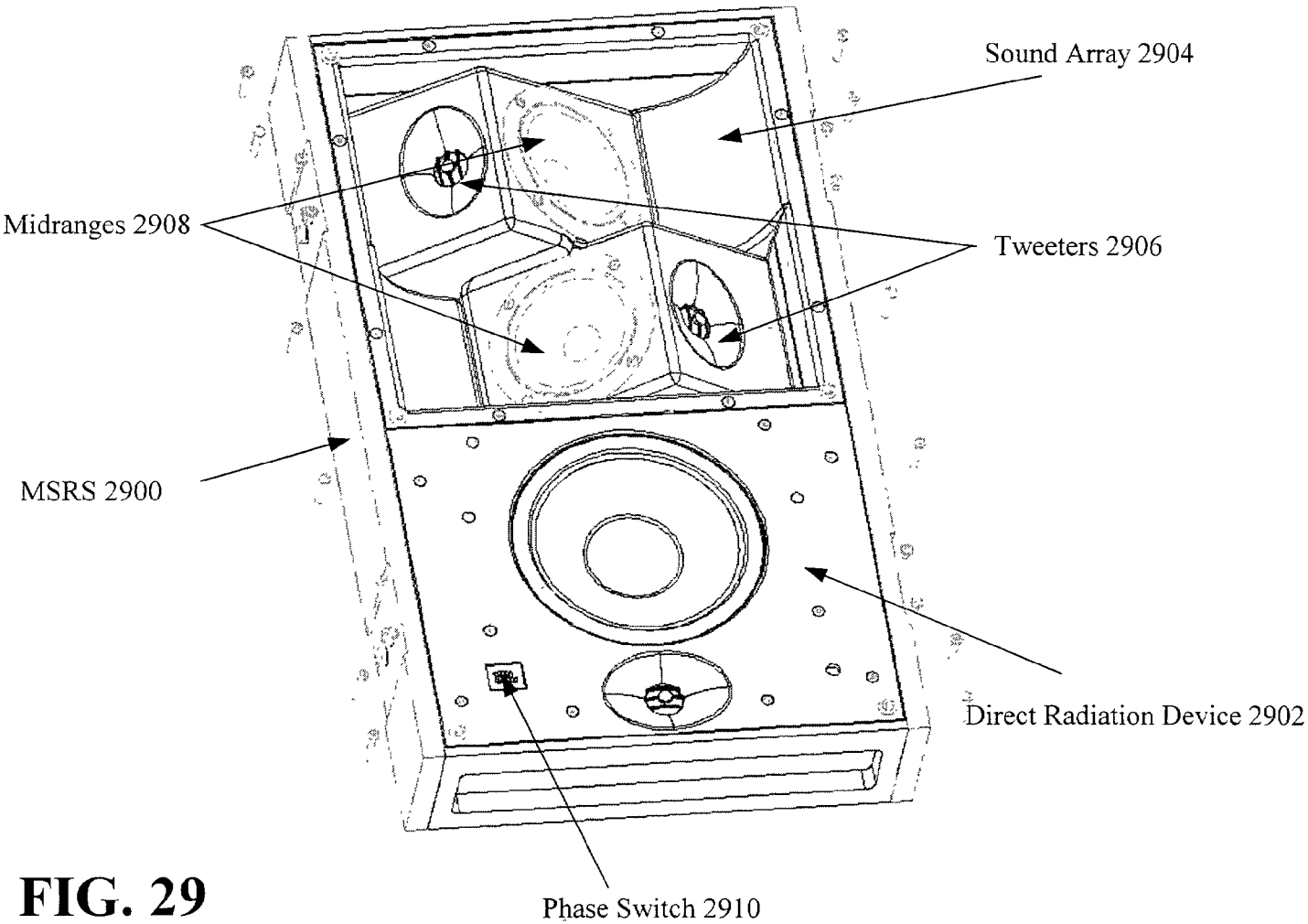
FIG. 29 is a front perspective view of a MSRS having a fixed direct radiation device and a rotateable sound array.

It is appreciated that walls and ceiling studs tend to run either along or across the surface area of wall or ceiling in a room. In order to create a proper sound stage the MSRS must be capable of producing a DIFFUSE pattern that runs from the front of the room to the back of the room. The requirement is the same regardless of whether the MSRS is placed within a wall surface or ceiling surface of the room. However, wall and ceiling studs do not always run from the front of the room to the back of the room. As such the MSRS should be capable of being installed in multiple positions. In FIG. 29, a MSRS 2900 for in-wall or in-ceiling installation is shown having a fixed direct radiation device 2902 and a rotateable sound array 2904 that allows the MSRS 2900 to be configured for vertical or horizontal use by rotating the tweeters 2906 and midranges 2908 and selecting phase switch 2910. The sound array 2904 is shown in FIG. 30.

Figure 30:
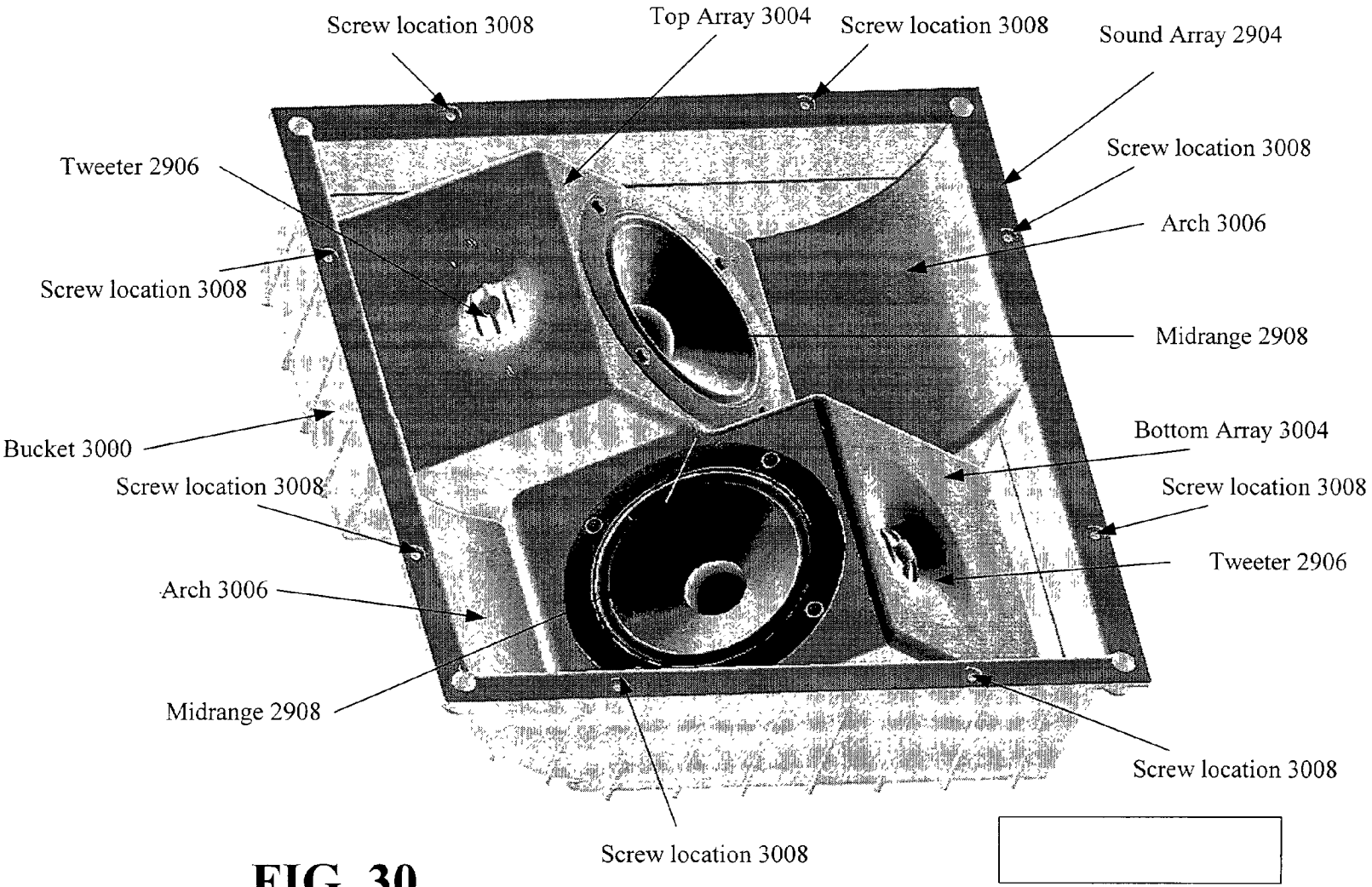
FIG. 30 is a front perspective view of the sound array of FIG. 29.

In FIG. 30, the sound array 2904 is shown including a bucket 3000 attached to a top array 3002 and bottom array 3004. The bucket 300 may also include two arches 3006, each located adjacent to the top array 3002 and bottom array 3004, respectively. The bucket 3000 may also include a plurality of screw hole (or other type of similar mechanical attachment points) locations 3008 for attaching the sound array 2904 to the MSRS 2900, FIG. 29. The bucket 3000 may be constructed of wood, metal or plastic such as ⅛-inch HIPS hard plastic with ribbing or other similar types of material. While the angle of the arches 3006 are not typically important, the arches 3006 may be curved (such as a sweeping arch) to diffuse any resulting diffraction pattern from the incident sound radiation received from the top array 3002 or bottom array 3004. Additionally, the arches 3006 absorbent material such as foam place along the surface of the arches 3006 to help absorb the incident sound radiation received from the top array 3002 or bottom array 3004. Examples of the foam may include ⅜-inch think foam with good absorption properties in the range of 500 Hertz to 20 KHz or above. As mentioned earlier, the sound array 2904 may be removed from the MSRS 2900, FIG. 29, and rotated by ±90 or ±180 degrees and re-attached to the MSRS 2900 via the screw locations 3008 to obtain the desired sound radiation pattern for the listening area in any room.

Figure 31:
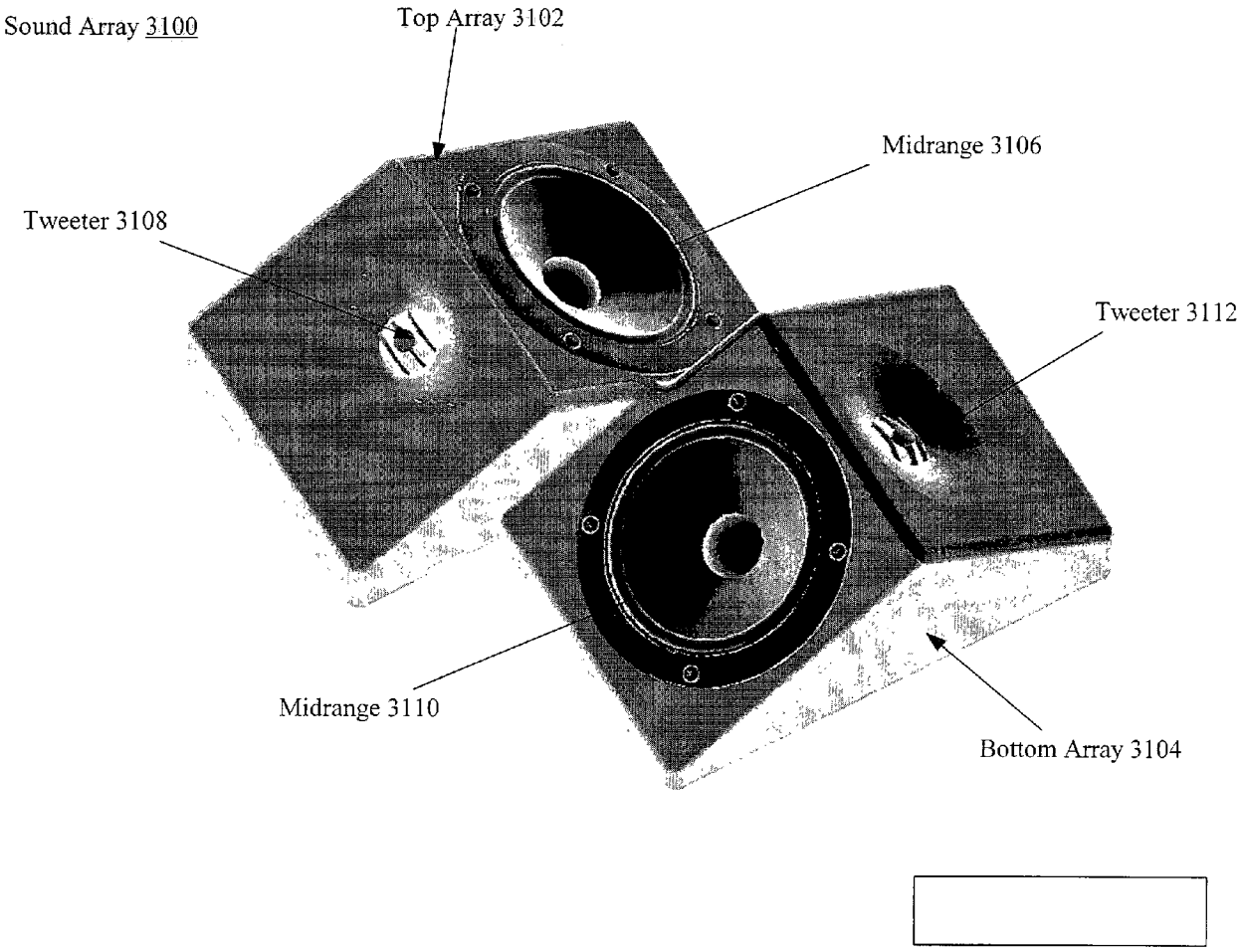
FIG. 31 is a front perspective view of the sound array having a top array and a bottom array.

FIG. 31 shows a front perspective view of the sound array 3100 having a top array 3102 and a bottom array 3104. The top array 3102 includes a midrange 3106 and tweeter 3108. Similarly, the bottom array 3104 includes a midrange 3110 and tweeter 3112. The sound array 3100 may be constructed with any ridge type material including wood, metal, and/or plastic. Examples of plastic would include ABS plastic, GE Norel 2 Plastic or other similar strong plastics. Typically, the thinness of the plastic would be about 0.150 inch for ABS.

Figure 32:
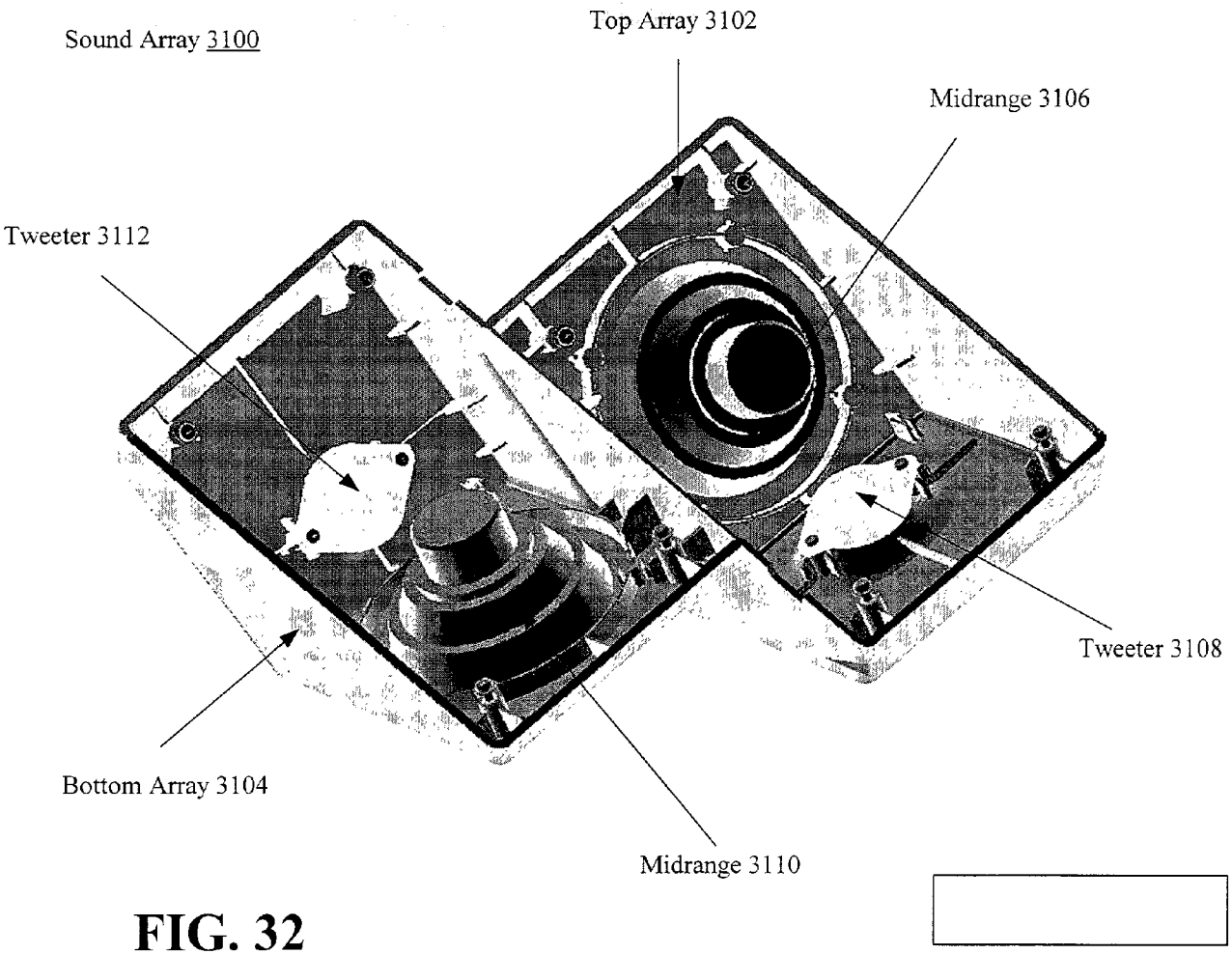
FIG. 32 is a rear perspective view of the sound array of FIG. 31.

The midranges 3106 and 3110 (also known as midrange transducers) may be each a four-inch neodymium full range midrange with rubber surround and cast aluminum basket, which may be driven from 400 Hz to 20 kHz. The tweeters 3108 and 3112 may be each a one-inch pure Titanium (or aquaplas-coated titanium) dome tweeter with rubber surround and shielded, with an EOS™ Waveguide, which may be driven from about 2.5 to 3.5 kHz and above. FIG. 32 is a rear perspective view of the sound array 3100 of FIG. 31.

Figure 33:
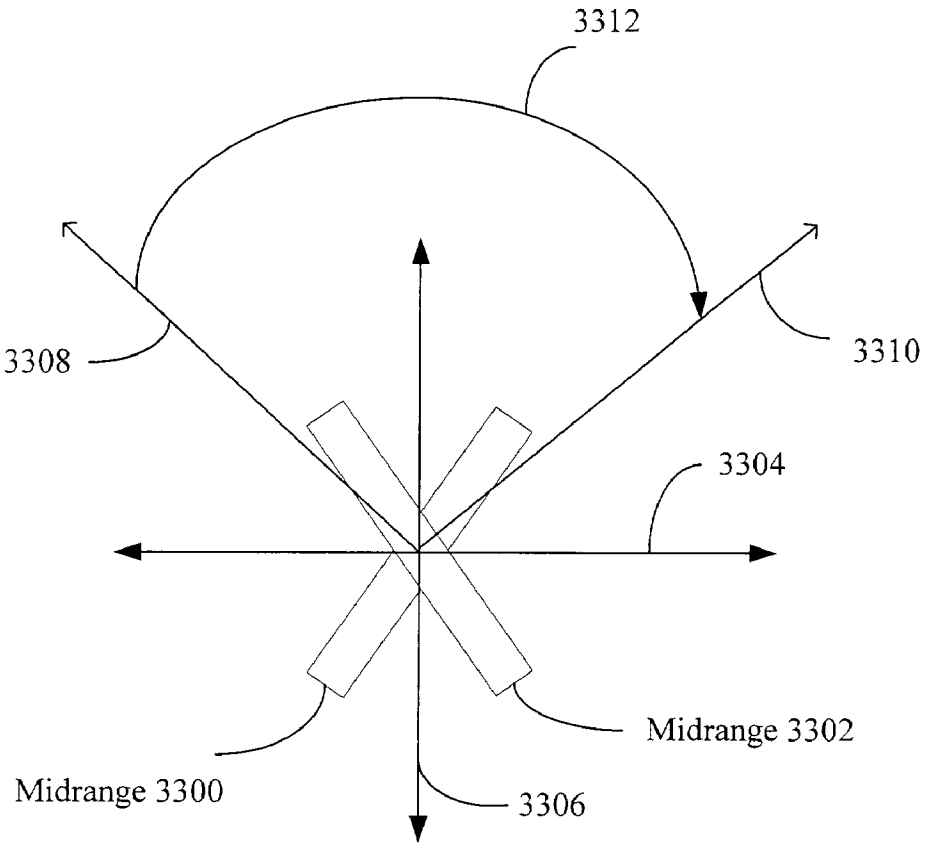
FIG. 33 is a vector diagram showing the respective firing angle of the midranges of the top array and bottom array of FIG. 31.

FIG. 33 is a vector diagram showing the respective firing angle of the top array midrange 3300 and bottom array midrange 3302. FIG. 33 includes a horizontal axis 3304 and vertical axis 3306. The midranges 3300 may be placed on an "on axis" location on the vertical axis 3306. In this location the normal vectors to the face of the midranges show the direction of the propagation of the sound radiation for each midrange. Thus, vector 3308 may be the direction of propagation of the sound radiation for midrange 3300 and vector 3310 may be the direction of propagation of the sound radiation from midrange 3302. Vector 3308 and vector 3310 define an off axis firing angle 3312. The angle 3312 may be chosen to optimize the sound radiation of the both midranges 3300 and 3302 and is determined based on the desired sound stage in a room and the spacing between studs in an in-wall or in-ceiling location. As an example, if the MSRS is installed in a location with a standard 16-inch stud spacing, the sound array may be only 14-inches wide. For dipole mode, the angle 3312 may then approximately 108 degrees to give good performance with a null that is approximately 20 dB down thought he on-axis listening location for a frequency range of approximately 800 Hz to 20 kHz. The sound power may then start to come back in at locations 10, 20 or 30 degrees off axis.

Figure 34:
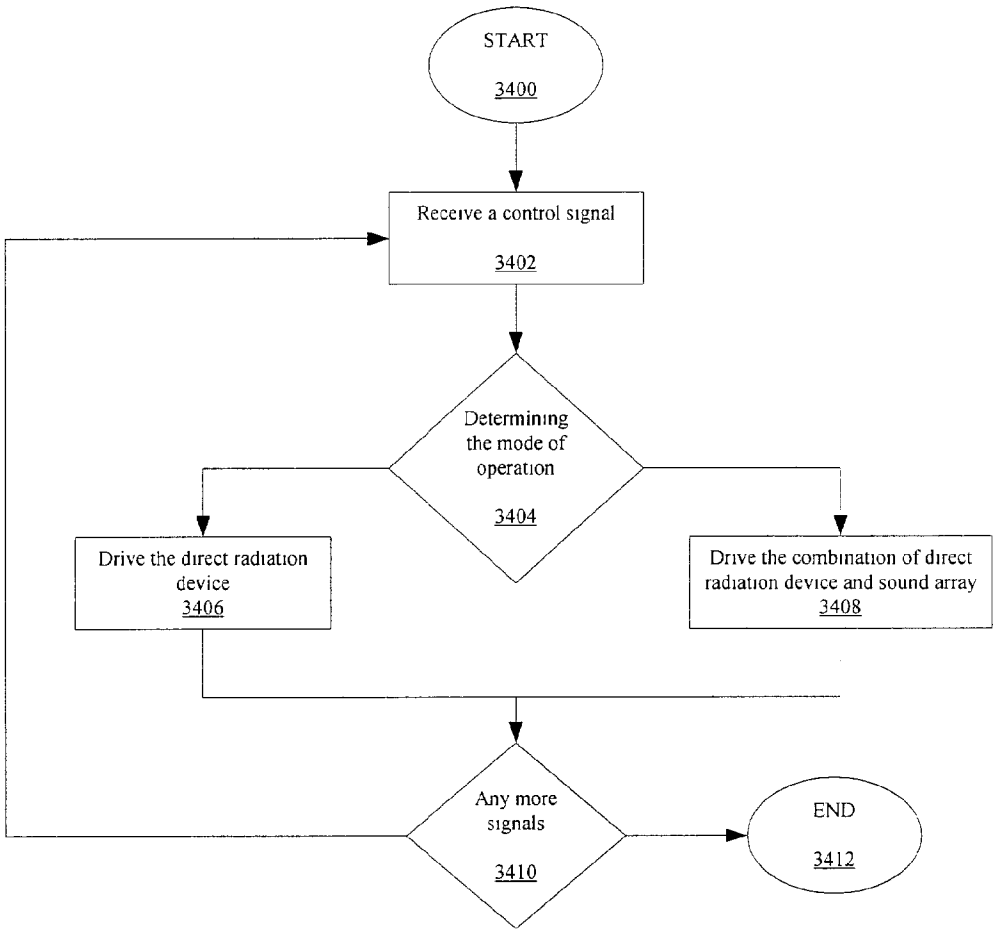
FIG. 34 is a flowchart illustrating an example process performed by MSRS of FIG. 2.

FIG. 34 is a flowchart illustrating an example process performed by MSRS 102 of FIG. 2. In FIG. 34, the process begins 3400 when a control signal is received 3402 by the control device 204 or 606, FIGS. 2 and 6, respectively. The control signal may have been produced by the controller 108, FIG. 1, and/or the sound processor 106. In response, the MSRS 102 determines mode of operation 3404 either through software (not shown) located on the control device 204 or 606 or through standard hardwired circuitry such as electronic or mechanical switches that have been designed to respond to a given characteristic in the control signal. The MSRS 102 then drives the direct radiation device 200 or 602 in step 3406 if the control signal is determined to indicated a direct mode of operation. Alternatively, if the control signal is determined to indicate a diffuse mode of operation, the MSRS 102 drives a combination of the direct radiation device 200 or 602 and the sound array 202 or 610 in step 3408. The MSRS 102 then determines 3410 if there are anymore control signals. If more control signals are received then the process repeats in step 3402. If, instead, there are no more control signals the process ends 3412.

The process in FIG. 34 may be performed by hardware of software. If the process is preformed by software, the software may reside in software memory (not shown) in the control device 204 or 206, the controller 108 or sound processor 106. The software in software memory may include an ordered listing of executable instructions for implementing logical functions, may selectively be embodied in any computer-readable (or signal-bearing) medium for use by or in connection with an instruction execution system, apparatus, or device, such as a computer-based system, processor-containing system, or other system that may selectively fetch the instructions from the instruction execution system, apparatus, or device and execute the instructions. In the context of this document, a "computer-readable medium" and/or "signal-bearing medium" is any means that may contain, store, communicate, propagate, or transport the program for use by or in connection with the instruction execution system, apparatus, or device. The computer readable medium may selectively be, for example but not limited to, an electronic, magnetic, optical, electromagnetic, infrared, or semiconductor system, apparatus, device, or propagation medium. More specific examples "a non-exhaustive list" of the computer-readable medium would include the following: an electrical connection "electronic" having one or more wires, a portable computer diskette (magnetic), a RAM (electronic), a read-only memory "ROM" (electronic), an erasable programmable read-only memory (EPROM or Flash memory) (electronic), an optical fiber (optical), and a portable compact disc read-only memory "CDROM" (optical). Note that the computer-readable medium may even be paper or another suitable medium upon which the program is printed, as the program can be electronically captured, via for instance optical scanning of the paper or other medium, then compiled, interpreted or otherwise processed in a suitable manner if necessary, and then stored in a computer memory.

While various embodiments of the application have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A multi-mode sound reproduction system (MSRS) comprising:

a direct radiation device and a sound array that produces a diffuse sound radiation and that is distinct from the direct radiation device, the direct radiation device and sound array arranged in a MSRS assembly operating as a single location sound source in a sound environment; and a selection device in signal communication with both the direct radiation device and sound array, the selection device being capable of selecting between the direct radiation device for a direct mode of operation and the combination of the sound array and direct radiation device for a diffuse mode of operation in response to a received control signal.

2. The system of claim 1, wherein the direct radiation device includes a first direct radiation loudspeaker and a second direct radiation loudspeaker.

3. The system of claim 2, wherein the first direct radiation loudspeaker is a low frequency loudspeaker.

4. The system of claim 3, wherein the low frequency loudspeaker is a dual-voice-coil type woofer loudspeaker.

5. The system of claim 2, wherein the second direct radiation loudspeaker is high frequency loudspeaker.

6. The system of claim 5, wherein the high frequency loudspeaker is a tweeter type loudspeaker.

7. The system of claim 1, wherein the sound array includes a sound array loudspeaker pair having a first sound array loudspeaker and a second sound array loudspeaker.

8. The system of claim 7, wherein the first sound array loudspeaker is midrange frequency loudspeaker.

9. The system of claim 8, wherein the second sound array loudspeaker is a high frequency loudspeaker.

10. The system of claim 9, wherein the high frequency loudspeaker is a tweeter type loudspeaker.

11. The system of claim 7, further including a second loudspeaker pair having a third sound array loudspeaker and a fourth sound array loudspeaker.

12. The system of claim 11, wherein the third sound array loudspeaker is midrange frequency loudspeaker.

13. The system of claim 12, wherein the fourth sound array loudspeaker is a high frequency loudspeaker.

14. The system of claim 13, wherein the high frequency loudspeaker is a tweeter type loudspeaker.

15. The system of claim 1, wherein the selection device is in signal communication with controller.

16. The system of claim 15, wherein the selection device is in signal communication with sound processor.

17. The system of claim 1, wherein the selection device is in signal communication with sound processor.

18. The system of claim 17, wherein the sound processor includes a surround sound processor.

19. The system of claim 17, wherein the selection device selects between a diffuse mode of operation and direct mode of operation.

20. The system of claim 1, wherein the direct radiation device is a loudspeaker physically separated from the sound array.

21. The system of claim 20, wherein the loudspeaker is BOSE 701 .RTM. loudspeaker.

22. A method for producing multi-mode sound from a single sound source location in a sound environment, the method comprising:

receiving a control signal; and determining the mode of operation of a loudspeaker having a direct radiation device for a direct mode of operation and a sound array that produces a diffuse sound radiation for a diffuse mode of operation, the sound array being distinct from the direct radiation device, where the mode of operation corresponds to the control signal.

23. The method of claim 22, further comprising driving the direct radiation device in response to the determined mode being direct mode.

24. The method of claim 23, further comprising driving a combination of the direct radiation device and sound array in response to the determined mode being diffuse mode.

25. A multi-mode sound system from a single sound source location in a sound environment, the system comprising:

means for receiving a control signal; and means for determining the mode of operation of a loudspeaker having a direct radiation device for a direct mode of operation and a sound array that produces a diffuse sound radiation for a diffuse mode of operation, the sound array being distinct from the direct radiation device, where the mode of operation corresponds to the control signal.

26. The system of claim 25, further comprising means for driving the direct radiation device in response to the determined mode being direct mode.

27. The system of claim 25, further comprising means for driving a combination of the direct radiation device and sound array in response to the determined mode being diffuse mode.

28. A signal-bearing medium having software for producing multi-mode sound, the signal-bearing medium comprising:

logic for receiving a control signal; and logic for determining the mode of operation of a loudspeaker having a direct radiation device for a direct mode of operation and a sound array that produces a diffuse sound radiation for a diffuse mode of operation, the sound array being distinct from the direct radiation device, the mode of operation corresponding to the control signal.

29. The signal-bearing medium of claim 28, further comprising logic for driving the direct radiation device in response to the determined mode being direct mode.

30. The signal-bearing medium of claim 28, further comprising logic for driving a combination of the direct radiation device and sound array in response to the determined mode being diffuse mode.

* * * * *